US009009886B2

(12) United States Patent
Hjort et al.

(10) Patent No.: US 9,009,886 B2
(45) Date of Patent: Apr. 21, 2015

(54) APPARATUS AND METHOD FOR ASSISTING IMPAIRED OR DISABLED PERSONS

(71) Applicant: Revac ApS, Korsor (DK)

(72) Inventors: Mogens Hjort, Korsor (DK); Jimmy Grotner, Gudhjem (DK); Henrik Hjort, Korsor (DK)

(73) Assignee: Revac ApS, Korosr (DK)

( * ) Notice: Subject to any disclaimer, the term of this patent is extended or adjusted under 35 U.S.C. 154(b) by 0 days.

(21) Appl. No.: 14/223,981

(22) Filed: Mar. 24, 2014

(65) Prior Publication Data

US 2014/0289960 A1 Oct. 2, 2014

(30) Foreign Application Priority Data

Mar. 26, 2013 (DK) ..... 2013 00181

(51) Int. Cl.
*A61G 7/10* (2006.01)
*A61G 5/14* (2006.01)

(52) U.S. Cl.
CPC ..... *A61G 5/14* (2013.01); *A61G 7/1019* (2013.01); *A61G 7/1046* (2013.01); *A61G 7/1086* (2013.01); *A61G 7/1092* (2013.01); *A61G 7/1069* (2013.01); *A61G 2200/34* (2013.01); *A61G 2200/36* (2013.01); *A61G 2203/16* (2013.01); *A61G 2203/32* (2013.01); *A61G 2205/60* (2013.01)

(58) Field of Classification Search
USPC ..... 5/81.1 R, 83.1, 87.1, 86.1; 414/921
See application file for complete search history.

(56) References Cited

U.S. PATENT DOCUMENTS

| | | | | |
|---|---|---|---|---|
| 4,117,561 | A | 10/1978 | Zamotin | |
| 4,375,840 | A | 3/1983 | Campbell | |
| 4,435,863 | A * | 3/1984 | Lerich | 5/87.1 |
| 4,918,771 | A * | 4/1990 | James | 5/87.1 |
| 5,001,789 | A * | 3/1991 | Schoenberger | 5/87.1 |
| 5,117,516 | A * | 6/1992 | Penner | 5/86.1 |
| 5,379,468 | A | 1/1995 | Cassidy et al. | |
| 6,382,039 | B1 | 5/2002 | Choi | |
| 7,392,554 | B1 * | 7/2008 | Su et al. | 5/86.1 |
| 8,375,484 | B2 * | 2/2013 | Ota et al. | 5/86.1 |
| 2007/0295126 | A1 | 12/2007 | Wang | |

(Continued)

FOREIGN PATENT DOCUMENTS

| | | | |
|---|---|---|---|
| BE | 1016574 | A3 | 2/2007 |
| CN | 101803988 | A | 8/2010 |

(Continued)

*Primary Examiner* — Robert G Santos
*Assistant Examiner* — Richard G Davis
(74) *Attorney, Agent, or Firm* — Ziegler IP Law Group, LLC

(57) ABSTRACT

An apparatus for assisting a person to move from a seated position on a seat to a standing position and vice versa. The apparatus includes a base, an actuator arrangement, and a torso support. The torso support has a main engagement surface for engaging the chest of the person. The actuator arrangement moves the torso support over a range of vertical and horizontal positions in a direction substantially perpendicular to the main engagement surface. The actuator arrangement moves the torso support in the vertical range of positions independently of the horizontal position of the torso support. The actuator arrangement moves the torso support in the horizontal range of positions independently of the vertical position of the torso support. The apparatus also includes a rotational actuator connected to the torso support for rotating the torso support about a substantially horizontal pivot axis.

6 Claims, 25 Drawing Sheets

(56) References Cited

U.S. PATENT DOCUMENTS

| | | | | |
|---|---|---|---|---|
| 2010/0154117 | A1* | 6/2010 | Odashima et al. | 5/87.1 |
| 2010/0224841 | A1 | 9/2010 | Liljedahl | |
| 2011/0120243 | A1 | 5/2011 | Pettersson | |
| 2011/0277235 | A1* | 11/2011 | Okumatsu | 5/83.1 |
| 2012/0023661 | A1 | 2/2012 | Ota et al. | |
| 2012/0174314 | A1* | 7/2012 | Clement et al. | 5/81.1 R |
| 2013/0263374 | A1* | 10/2013 | Yamaguchi et al. | 5/87.1 |

FOREIGN PATENT DOCUMENTS

| | | | |
|---|---|---|---|
| DE | 2815763 | A1 | 10/1979 |
| DE | 202008008144 | U1 | 1/2009 |
| EP | 1591038 | A1 | 11/2005 |
| EP | 1772132 | A1 | 11/2007 |
| EP | 2438894 | A1 | 4/2012 |
| JP | H0 6225909 | | 8/1994 |
| TW | 200819119 | A | 5/2008 |
| WO | 93/10738 | A1 | 6/1993 |
| WO | 99/52739 | A1 | 10/1999 |
| WO | 01/73340 | A1 | 10/2001 |
| WO | 03/007866 | A1 | 1/2003 |
| WO | 2009/126040 | A2 | 10/2009 |
| WO | 2011/058445 | A1 | 5/2011 |
| WO | 2012/090248 | A1 | 7/2012 |

* cited by examiner

APPARATUS AND METHOD FOR ASSISTING IMPAIRED OR DISABLED PERSONS

CROSS-REFERENCE TO RELATED APPLICATIONS

This application claims priority to, and the benefit of, Danish Patent Application No. 2013 00181, filed on 26 Mar. 2013, now Danish Patent No. 177674 B1, granted on 17 Feb. 2014, the disclosure of which is incorporated herein by reference in its entirety.

BACKGROUND

1. Field

The present disclosure relates to an apparatus and method for disabled, impaired or handicapped persons or patients for assisting them and training them with various movements, such as rising from a seated position to a standing position and vice versa. The apparatus is intended for assisting persons that have reduced strength and control, and is not intended for completely lamed or partially fully disabled persons. The apparatus is provided with a base, with an actuating mechanism and with a torso support for engaging the person to be assisted.

2. Brief Description of Related Developments

Sit-to-stand lifts are designed to help patients with some mobility but who lack the strength or muscle control to rise to a standing position from a bed, wheelchair, chair, or commode. Conventional lifts use straps, vests, or belts or slings positioned around the patient's back usually fitting under their arms to make the transition possible.

Most of these apparatuses are based on a pivoting lifting arm with a belt, strap or sling attached thereto, in combination with a footplate and a knee support, as known from U.S. Pat. No. 4,918,771. The lifting arm pivots from a substantially horizontal position upwards. All of these apparatuses are based on the principle that the centre of gravity is positioned well behind the footplate/knee support during almost the complete lifting procedure so that the person "hangs" in the sling that is positioned around the persons back and/or abdominal region. With the centre of gravity of the person to be assisted so far behind the footplate/knee support the weight carried by the sling to the person to be assisted is quite significant, which leads to a high load on back and shoulders of the person to be assisted.

EP1772132 discloses an apparatus and procedure for assisting persons in reaching and maintaining an upright position that uses a torso support for engaging the person to be assisted and allows for raising movement in which the torso support moves simultaneously forward and upward.

However, none of these prior art apparatuses provide for individually adapted assistance with optimal comfort and security. In particular, adaptation to different size and level of impairment has not been practically possible with the known apparatuses.

SUMMARY

In view of the problems associated with the prior art set out above it is an object of the present disclosure to provide apparatuses and methods that overcome or at least reduce the drawbacks associated with the prior art.

In order to achieve this object there is provided an apparatus for assisting a person to move from a seated position on a seat or the like to a standing position and vice versa, said apparatus comprising: a base; an actuator arrangement supported by said base; a torso support configured for supporting the torso and possibly also the underarms of the person to be a supported with the chest of the person facing the torso support; said torso support having a main engagement surface for engaging the chest of the person to be assisted, said actuator arrangement being configured to be able to move said torso support up and down over a range of vertical positions and said actuator arrangement being configured to be able to move said torso support back and forth over a range of horizontal positions in a direction substantially perpendicular to said main engagement surface; wherein said actuator arrangement is configured to move said torso support in said vertical range of positions independently of the horizontal position of the torso support; and wherein said actuator arrangement is configured to move said torso support in said horizontal range of positions independently of the vertical position of the torso support; a rotational actuator operatively connected to said torso support for rotating said torso support about a substantially horizontal pivot axis.

By providing an apparatus that is capable of providing any desired movement profile/path in the horizontal and vertical direction in combination a rotatable torso support an ideal movement support for a given person can be achieved. During a raising or lowering movement the torso support should ideally adapt its rotational position continuously, and with the apparatus defined in the claims this is possible.

In an embodiment said pivot axis is substantially parallel to said main engagement surface.

In another embodiment the actuator arrangement including said rotational actuator is connected to a processor and operated under command of said processor.

In another embodiment the rotational angle of said torso support can be adjusted independently of the horizontal position of the torso support and independently of the vertical position of the torso support.

In another embodiment said rotational actuator comprises an electric drive motor.

In another embodiment said actuator arrangement comprises two linear actuators with an electric drive motor each, said apparatus further comprising a processor operatively coupled to all of said electric drive motors and said processor being configured to control the activation of said drive motors simultaneously.

It is another object of the disclosure to provide a method for operating a person lift for assisting a person in a raising or lowering movement, comprsing The object above is also achieved by providing a method for operating a person lift for assisting a person in a raising or lowering movement, the apparatus comprising a base; an actuator arrangement supported by the base; a torso support configured for supporting the torso and possibly also the underarms of the person to be a supported with the chest of the person facing the torso support; the torso support having a main engagement surface for engaging the chest of the person to be assisted, the actuator arrangement being configured to be able to move the torso support up and down over a range of vertical positions and the actuator arrangement being configured to be able to move the torso support back and forth over a range of horizontal positions in a direction substantially perpendicular to the main engagement surface; the actuator arrangement is configured to move the torso support in the vertical range of positions independently of the horizontal position of the torso support; and the actuator arrangement is configured to move the torso support in the horizontal range of positions independently of the vertical position of the torso support; a rotational actuator operatively connected to the torso support for rotating the torso support about a substantially horizontal pivot axis, the method comprising carrying out a movement with the torso support for supporting the person according along a predetermined path and with a predetermined rotational angle for each position along the path.

Further objects, features, advantages and properties of the apparatus and method according to the disclosure will become apparent from the detailed description.

BRIEF DESCRIPTION OF THE DRAWINGS

In the following detailed portion of the present description, the disclosure will be explained in more detail with reference to the exemplary embodiments shown in the drawings, in which.

DETAILED DESCRIPTION OF THE DISCLOSED EMBODIMENTS

Figure 1:
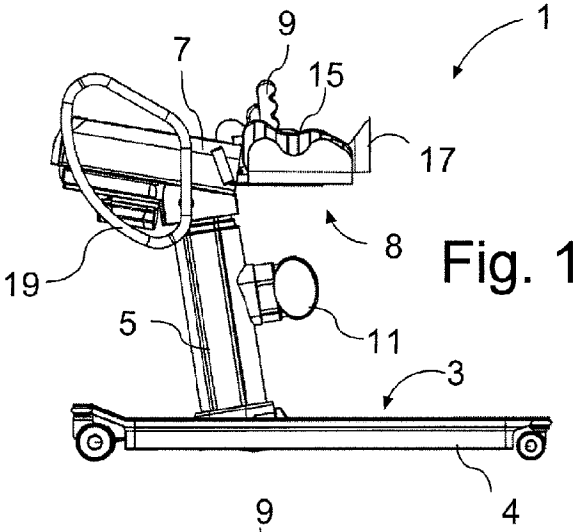
FIG. 1 is a side view of an example embodiment of an apparatus for assisting persons.
Figure 2:
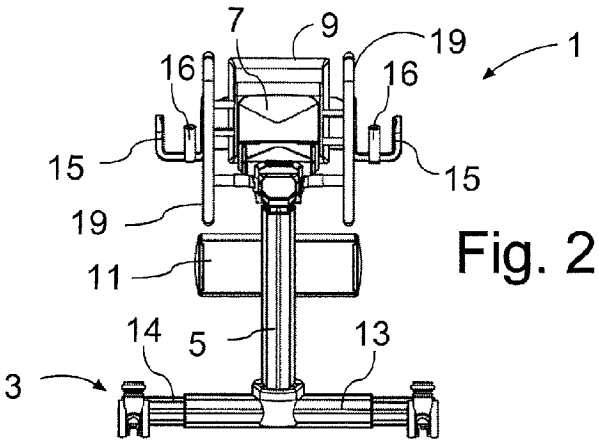
FIG. 2 is a front view of the apparatus according to FIG. 1.
Figure 3:
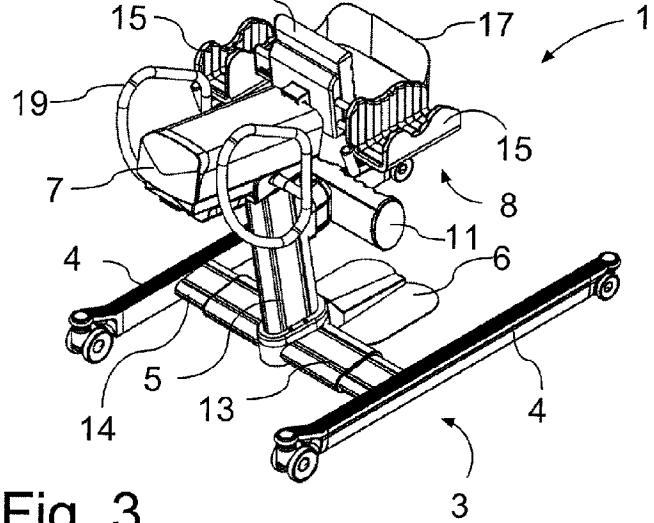
FIG. 3 is an elevated view of the apparatus according to FIG. 1.
Figure 4:
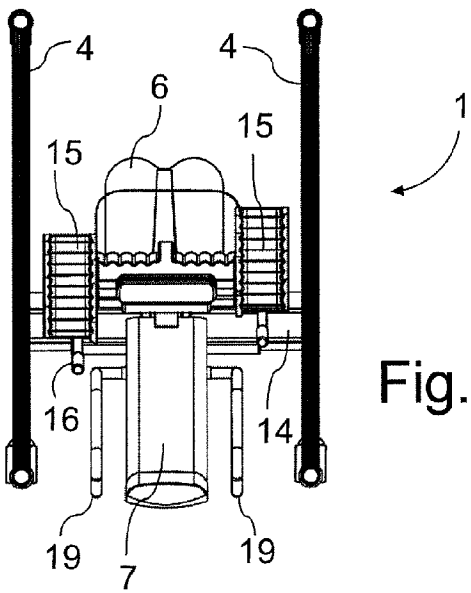
FIG. 4 is a top view of the apparatus according to FIG. 1.

With reference to FIGS. 1 to 4 and apparatus for assisting a person from a seated position to a fully or partially raised position according to an example embodiment is illustrated in side, front, top and elevated views. The apparatus 1 includes a base 3 that supports a substantially vertical column 5. The base 3 is formed by a pair of spaced parallel bars 4. The spaced bars 4 are at their ends provided with wheels, such as caster wheels for rendering the apparatus movable. The spaced parallel bars 4 are connected by a telescopic transverse rod 13,14. The telescopic transverse rod includes two sections 14 that are rigidly connected to the spaced parallel bars 4. The sections 14 are slidably received in a central section 13. A substantially upright column 5 is rigidly connected to and supported by section 13. A footplate 6 for supporting the defeat of a person to be assisted is supported by section 13. A knee support 11 is supported by the upper right column 5. The knee support 5 extends substantially horizontally and includes a pad for each knee of the person to be supported. The knee abutment surface can be contoured to prevent and sideward moment of the knees. The term "knee support" as used herein includes any support it provides abutment surface for the higher shins and/or for the knees. The knee support 11 (adjustable in height) can be a movable or adjustable support that is either motorized or spring biased to be able to move in the directions traverse to the surface of the pads. The substantially upright column 5 is extendable in length due to an inbuilt actuator. This actuator is described in greater detail further below.

A substantially horizontal column 7 is supported by and connected to the upper end of the upright column 5 i.e. the substantially horizontal column 7 is supported by the extendable portion of the upright column 5. The substantially horizontal column 7 is extendable in length due to an inbuilt actuator (this actuator is described in greater detail further below). A torso support 8 is operatively connected to the free end of the horizontal column 7, i.e. the extendable end of the horizontal column 7. The torso support 8 includes a main engagement surface formed by a pad or pillow 9 for engaging the chest of the person to be assisted. At least the main support surface of the torso support is upholstered, i.e. covered with a soft resilient layer under a skin or textile lining, to create a comfortable pillow-like structure. In an embodiment, this pad or pillow 9 is configured for adapting its shape to the form of the chest of the person that is capable of locking such a shape. The details of the pad or pillow 9 and its operation are described in further detail below. The torso support 8 also includes two armrests 15, one at each side of the pillow 9, for supporting the underarms the person to be assisted. Each of the armrests 15 also includes a forwardly protruding handle 16 for grasping by the hands of the person to be assisted. The distance between the main support surface and of the torso support the handles 16 corresponds to the average length of the human underarm and can be adjusted to match individual variations. The torso support 8 also includes a back strap 17 for going around the back of the person to be assisted and ensuring that the person to be assisted does not loose contact from the torso support. The torso support is rotatable around a horizontal axis that is located at the connection between the horizontal column 7 and the torso support 8. The apparatus 1 is also provided with two handles 19 for manipulation by an operator of the apparatus 1.

Figure 6:
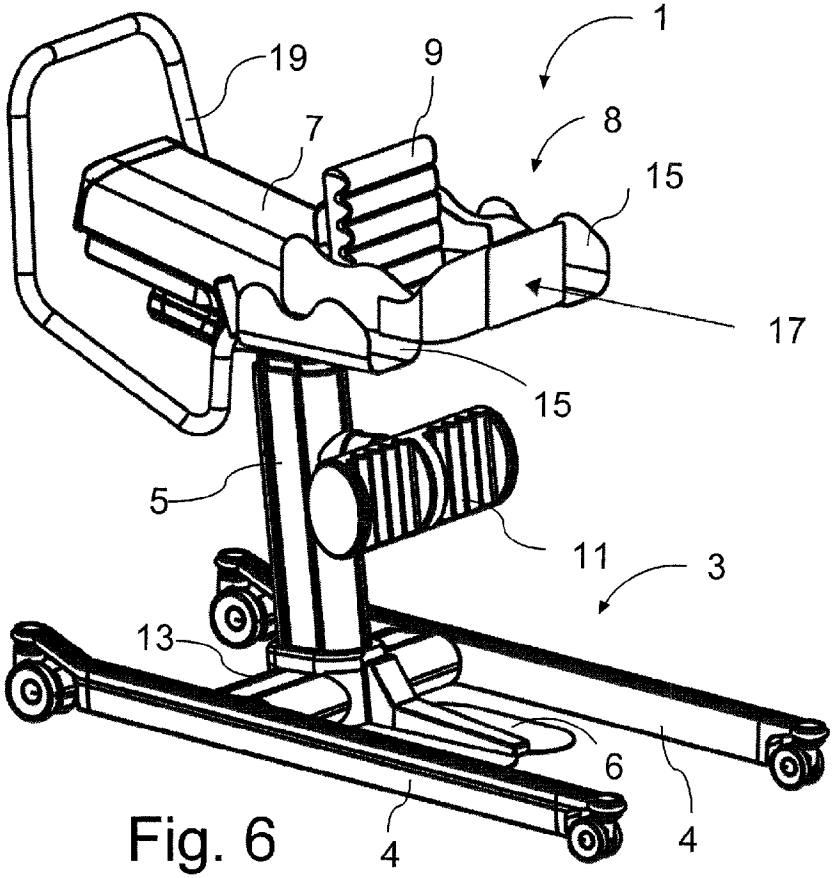
FIG. 6 is another elevated view of the apparatus of FIG. 1 illustrating the operation of the upper actuation column in detail.
Figure 5:
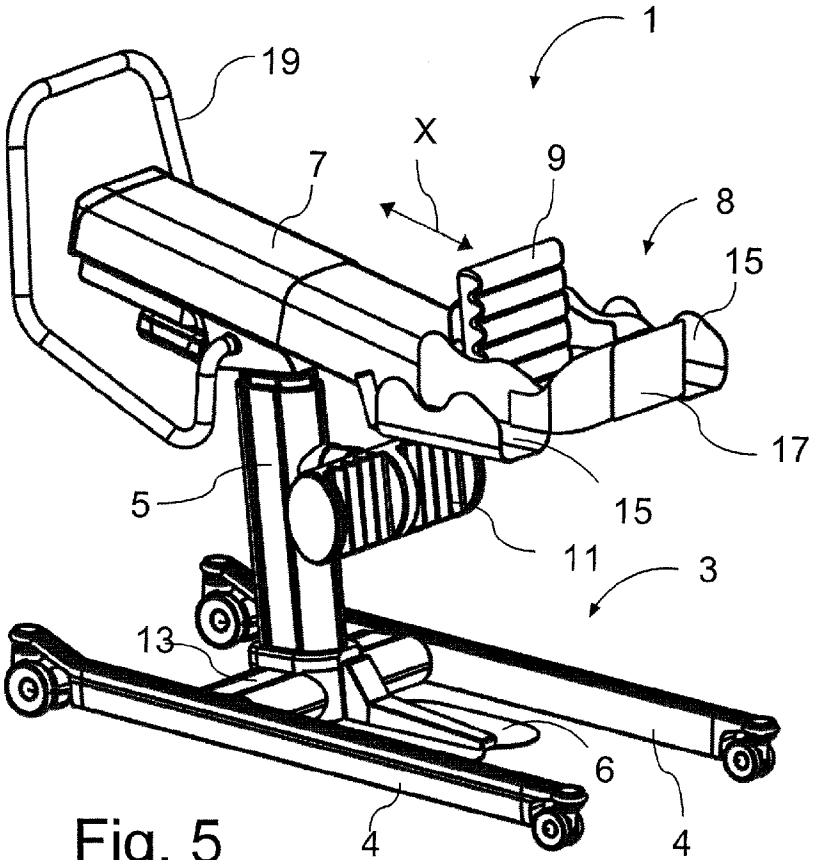
FIG. 5 is an elevated view of the apparatus of FIG. 1 illustrating the operation of an upper actuation column in detail.

FIGS. 5 and 6 illustrate the operation of the horizontal column 7 in greater detail. The arrow X shows the direction of movement of the extendable horizontal column 7. In FIG. 5 the extendable horizontal column 7 is in an extended position and in FIG. 6 the extendable horizontal column 7 is in a retracted position. The handle 19 for manipulation by an operator is in the embodiment of FIGS. 5 and 6 formed from one piece of tubing material, whereas the embodiment of FIGS. 1 to 4 had to separate handles made of tubing material. This we noted that the back strap 17 can be detached at one or both of its ends so as to allow the torso of a person to be supported to engage the engagement surface 9 of the torso support 8.

Figure 7:
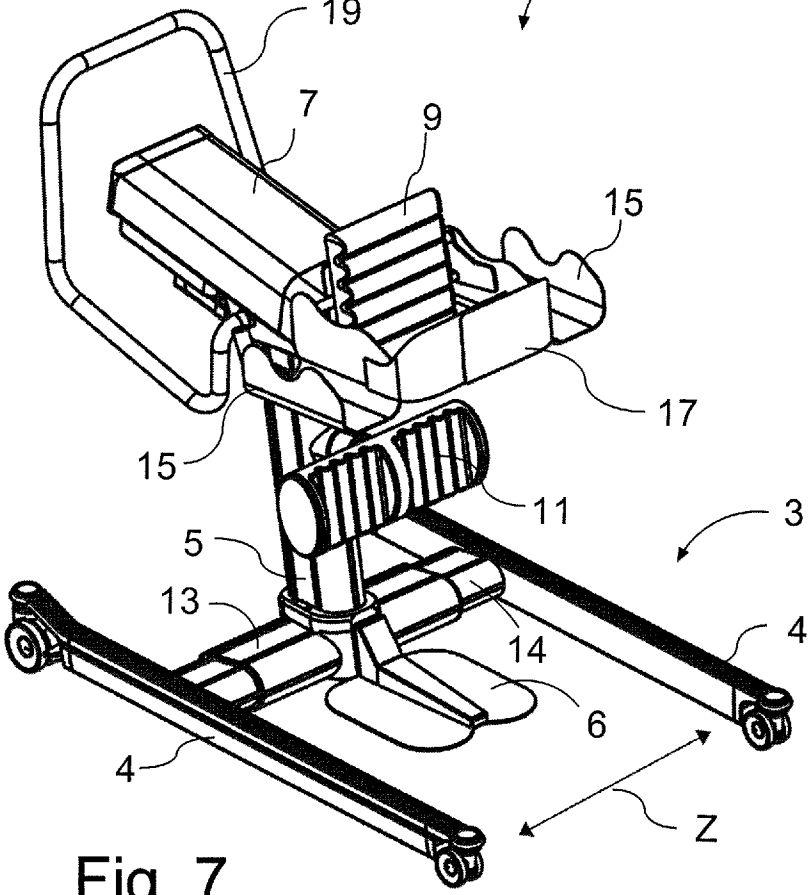
FIG. 7 is another elevated view of the apparatus of FIG. 1 illustrating the operation of a base of the apparatus in detail.

With reference to FIG. 7, it is illustrated how the distance between the spaced parallel bars 4 can be adapted. The adaption of the spacing indicated by the arrow Z can be motorized or manual and is enabled by the telescopic action of the rods 14 in the rod section 13. The adaption of the distance between the parallel bars is especially useful for being able to maneuver through narrow passages or doors.

Figure 8:
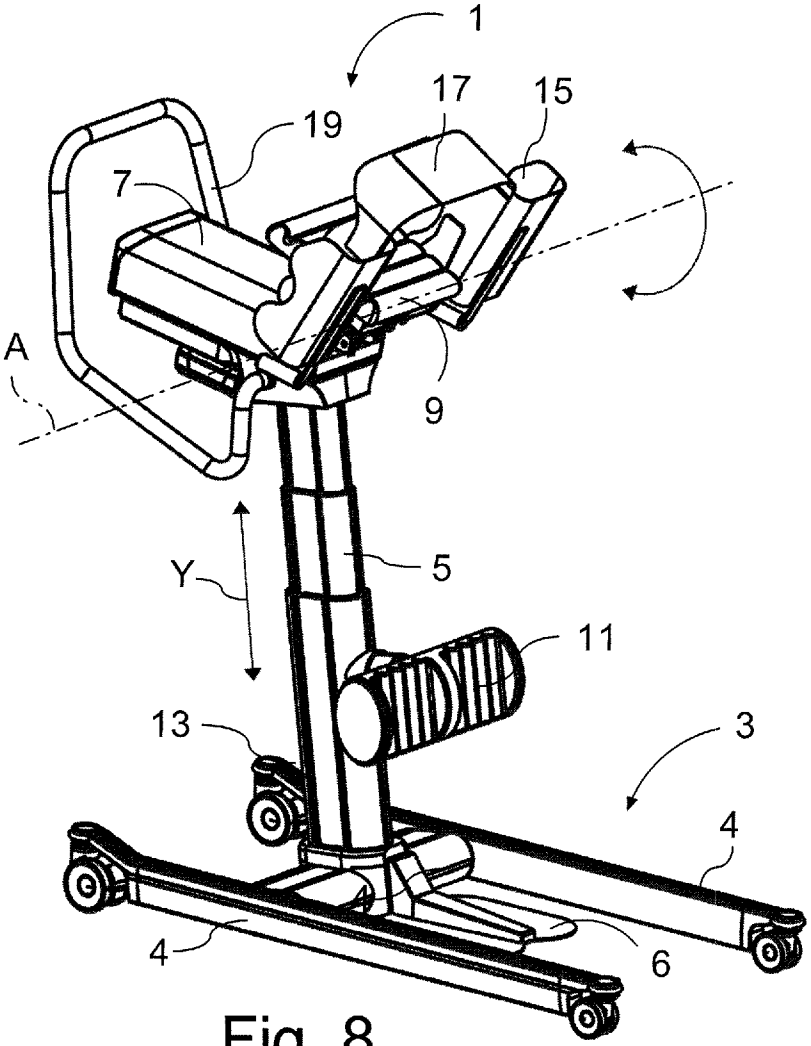
FIG. 8 is another elevated view of the apparatus of FIG. 1 illustrating the operation of a torso support of the apparatus in detail.
Figure 9:
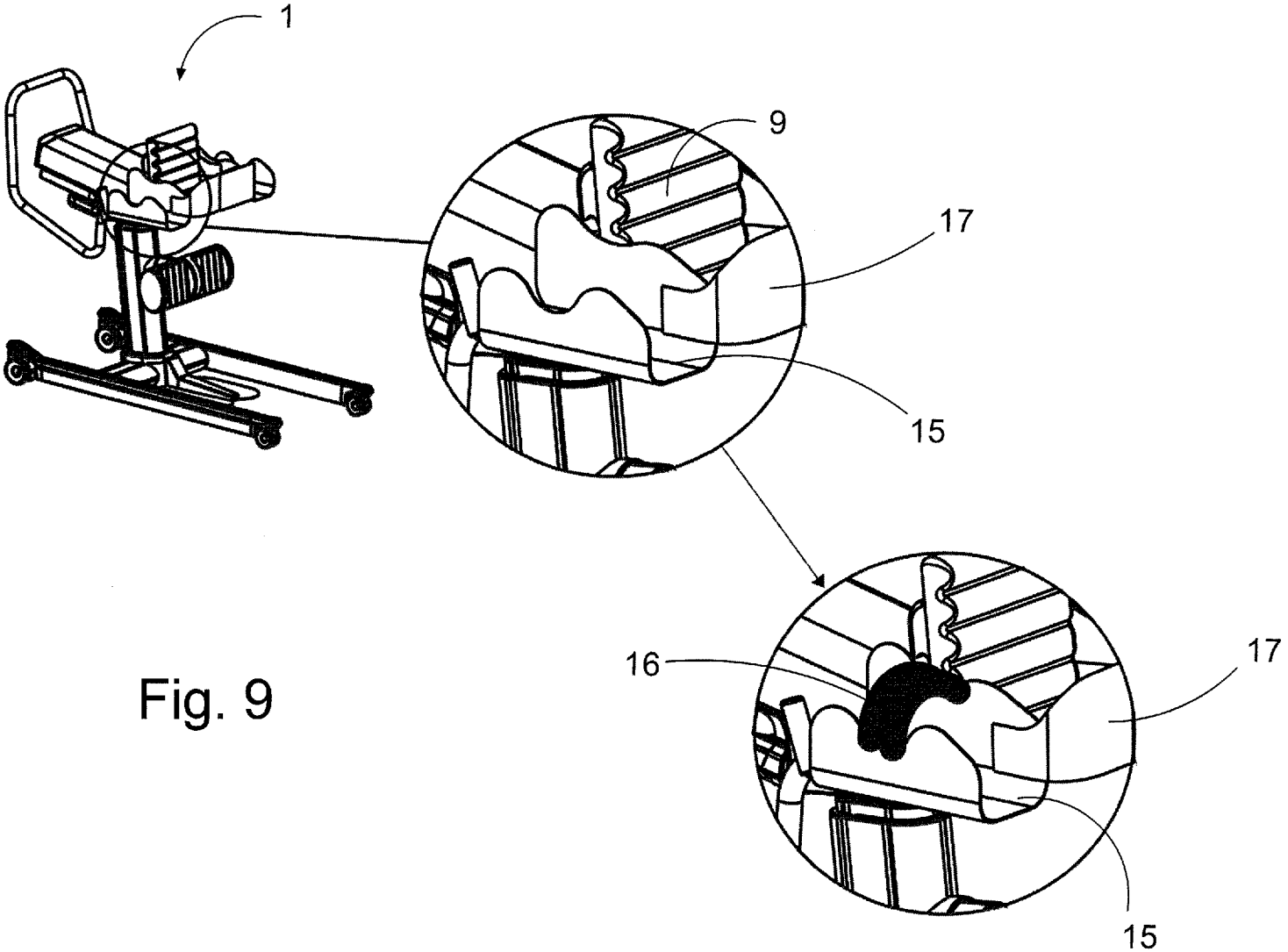
FIG. 9 is another elevated view of the apparatus of FIG. 1 illustrating the operation of armrests of the apparatus in detail.
Figure 13:
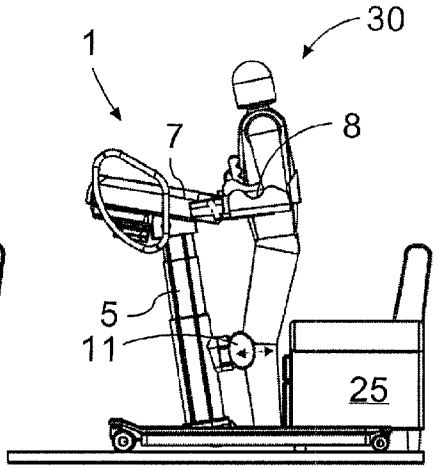

With reference to FIG. 8, it is illustrated how the substantially upright column 5 can be adjusted in length, thereby adjusting the height of the torso support. FIG. 8 illustrates how the torso support can be rotated about a substantially horizontal axis A by movement in the direction of the arrow X. Respective actuators for movement in the direction of the arrow X and for rotation about axis A are built into the column 7 and illustrated in greater detail further below. The actuators in the vertical column 5, the horizontal column 7 and the rotational actuator formed together and actuator arrangement of the apparatus or one that is suited for torso support 8 over range of vertical positions and horizontal positions independently from one another. Also the rotational position is independent from the horizontal and vertical position. In With reference to FIG. 9, straps 16 for securing the arm of the person to be assisted are disclosed. The straps 16 cover the armrests 15 and ensure that the underarm of the person to be assisted will not inadvertently disengage the armrest. At least one end of the strap 16 is engageable and disengageable with the armrest in order to be securely locked to the armrest 15. In an embodiment, the strap 16 is disengageable from the armrest 15 at both of its ends so that the apparatus 1 can be operated without the security measure.

FIGS. 10 to 13 illustrate the procedure of assisting a person 30 to be assisted from a sitting position on a chair 25 to a substantially raised position. The chair 25 is an example of a possible starting position. However the starting position could be sitting on a bench, a bed, a toilet or any other suitable object. At the start of the procedure the apparatus 1 is rolled towards the person to be assisted 30 with the torso support 8 directed towards the person to be supported 30. The engagement surface of the torso support is brought into contact with the person to be supported and in an embodiment the engagement surface is formed by a pillow 9 that can adapt its shape to the object that it engages and thereafter be locked in that shape. The details of the construction of this pillow 9 are described further below. The person to be assisted 30 places his or her underarms in the armrests 15 and engages the grip 16 with his hands. The person to be assisted 30 also places his or her feet onto the foot plate 6. At this moment, the person to be assisted is ready to be assisted to be raised from the chair 25. As indicated by the double arrowed line in FIGS. 11-14, the knee support 11 is arranged movable, so as to accommodate movements in the horizontal direction of the knee as will be present in the knees of a person that rises from a seated position without the aids of a lift. In an embodiment the knee movement is allowed by a resilient element, such as a gas spring or a helical wire spring. In an embodiment the characteristic of the spring is adjustable so as to accommodate the need of the person to be assisted.

Figure 15B:
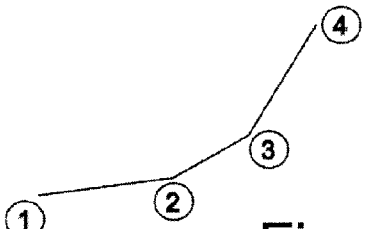
Figure 15A:
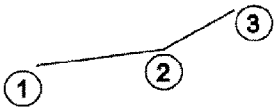

The raising movement is then carried out in accordance with a personal movement profile, to a partially of fully standing position. FIG. 15*a* shows diagrammatically (not an actual curve of a movement profile to be used for a person) illustrating a movement that ends with a partially raised person, end position 3 of FIG. 15*b* corresponding to the position shown in FIG. 12. FIG. 15*b* shows diagrammatically (not an actual curve of a movement profile to be used for a person) illustrating a movement that ends with a fully raised person, end position 4 of FIG. 15*b* corresponding to the position shown in FIG. 13.

As will be described in greater detail further below, the apparatus 1 is configured so as to identify the person 30 to be assisted. The upper is one is also configured to retrieve and store data associated with this person for various reasons. One of the reasons is to obtain the person's anthropometric data and degree of disability in order to determine the appropriate movement profile. The raising procedures are performed in accordance with the movement profile that is optimal for the person concerned. The determination of the optimal movement profile is described in further detail below.

Figure 12:
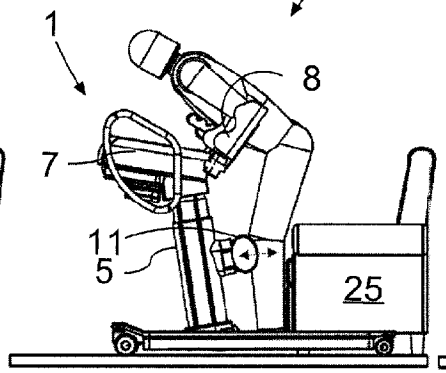
Figure 11:
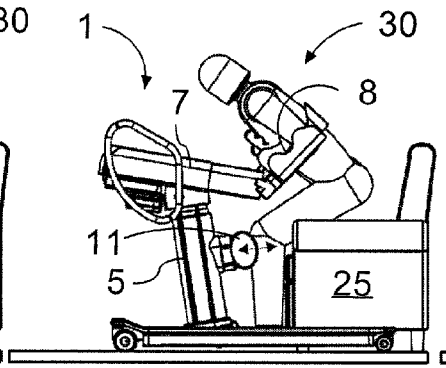
Figure 10:
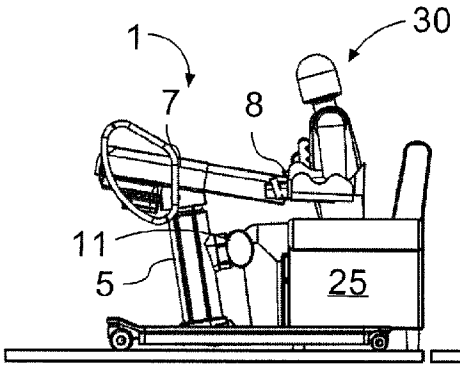
FIG. 10 illustrates the procedure of assisting a person in which the torso support is brought into contact with the seated person, FIG. 11 further illustrates the procedure of assisting a person in which movement of the torso support starts with a retraction of the horizontal column and anticlockwise rotation of the torso support, FIG. 12 further illustrates the procedure of assisting a person in which the upright column has started to extend, FIG. 13 further illustrates the procedure of assisting a person in which the person is brought to a raised position.
Figure 14:
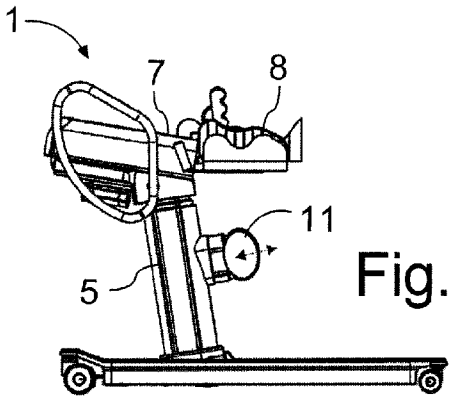
FIG. 14 illustrates the apparatus of FIG. 1, FIGS. 15*a* and 15*b* schematically illustrate the movement of the apparatus according to FIG. 1 in relation to FIGS. 10 to 13.
Figure 17:
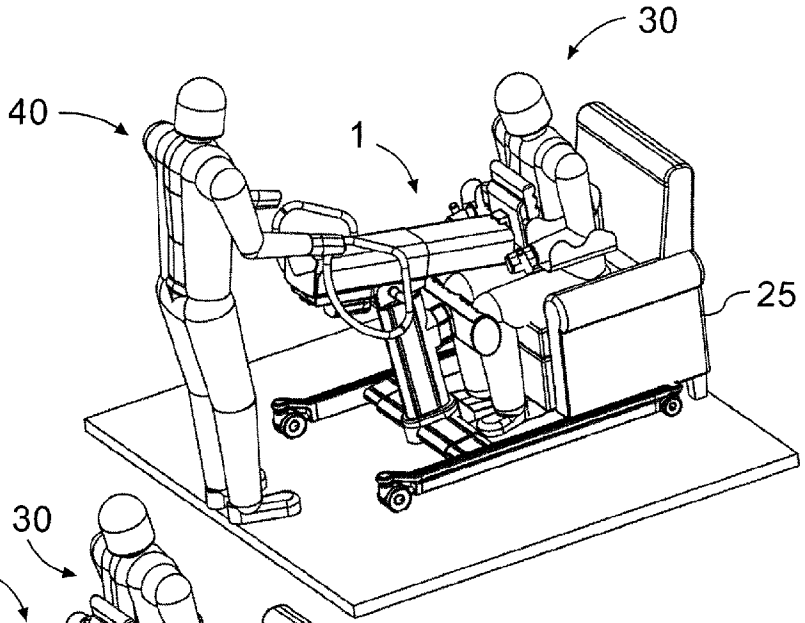
FIG. 17 illustrates the operation of FIG. 16 in which the operation has been initiated.
Figure 16:
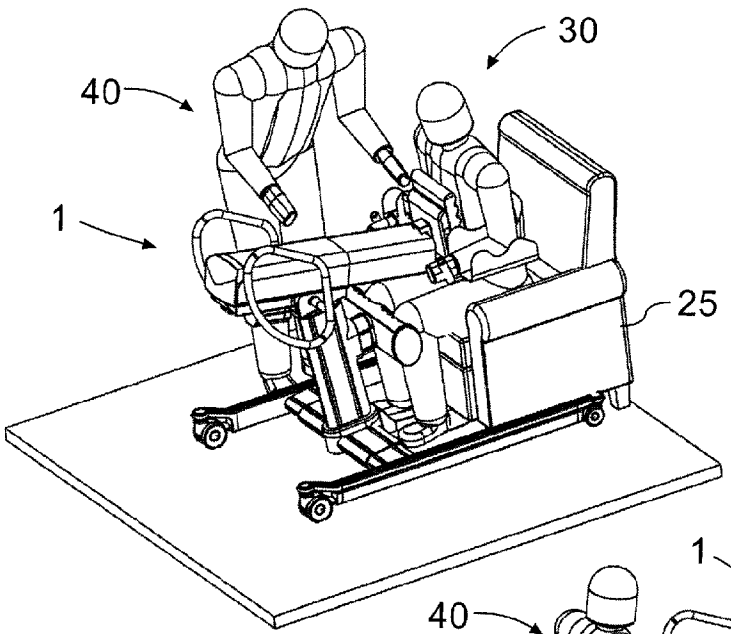
FIG. 16 illustrates the operation of the apparatus according to FIG. 1 and a sequence of movements and including an operator of the apparatus in which a person to be assisted is seated.
Figure 18:
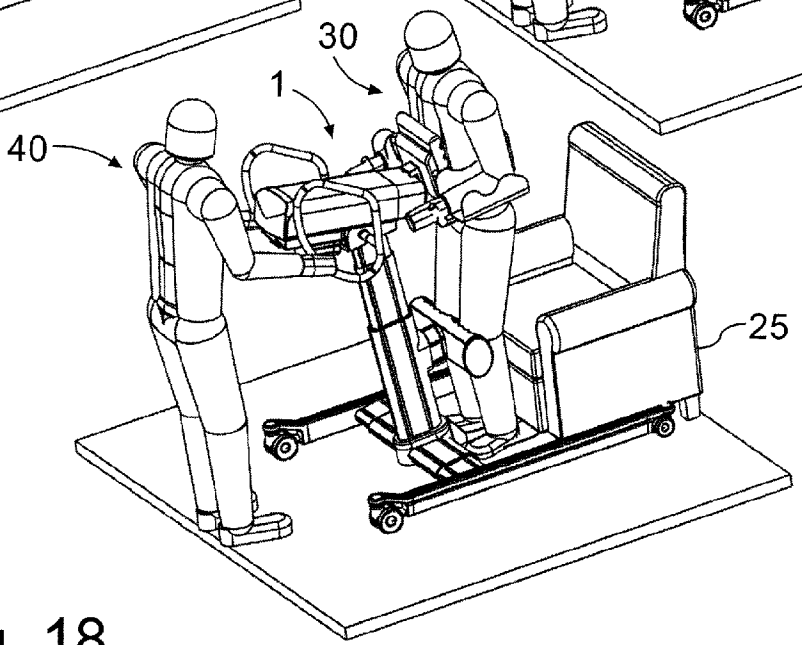
FIG. 18 illustrates the operation of FIG. 16 in which the person is brought to the raised position.
Figure 20A:
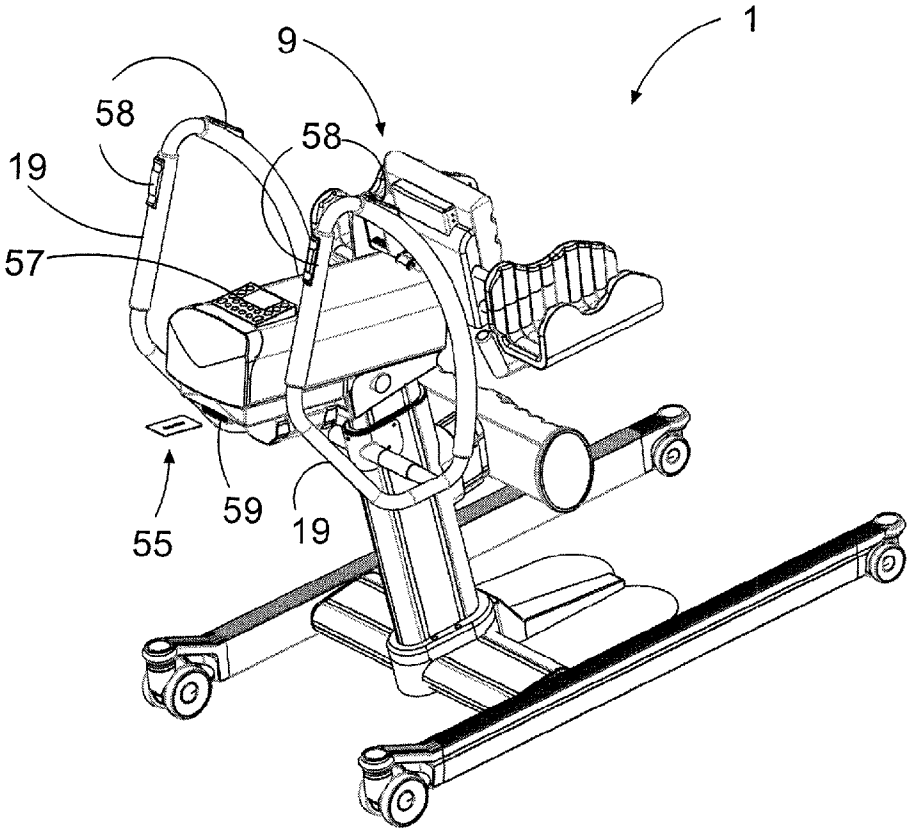
FIG. 20*a* is an elevated view of the apparatus according to FIG. 1 illustrating the user interface and a person identification system.

The actuator in the upright column 5, the actuator in the horizontal column 7 and the actuator for rotation of the torso support can be operated independently from one another. Therefore, the torso support can perform a movement along a path and with the rotational angle of the torso support that is freely selectable within the maximum range of the respective actuators. Further, the speed of the respective actuators is also independently selectable. When the appropriate profile has been found for the person to be assisted 30, the process of raising the person 30 can start. An appropriate profile is a movement profile that resembles closely the natural movement of a person. As can be seen in FIG. 11, movement of the torso support starts with a retraction of the horizontal column 7 and an anticlockwise rotation (anticlockwise as in FIG. 11) of the torso support 8. In the next phase of the movement that is illustrated in FIG. 12, the horizontal column 7 keeps on retracting and the torso support keeps on rotating anticlockwise but also the upright column 5 has started to extend so that the torso support is now also moving upwards. The last part of the movement towards the race position is mainly a further extension of the horizontal column 7 and a clockwise rotation of the torso support 8 in order to arrive at the position illustrated in FIG. 13. It should be noted that this is an example of possible movement and that this one is adapted to a specific person to be assisted, and the order and magnitude of the various activations of the actuators can be completely different for other situations. The procedure of assisting a person to be assisted 30 from a seated position on the chair 25 to a raised position is also illustrated with reference to FIGS. 16, 17 and 18 at this time also showing an operator 40 of the apparatus 1.

Figure 19:
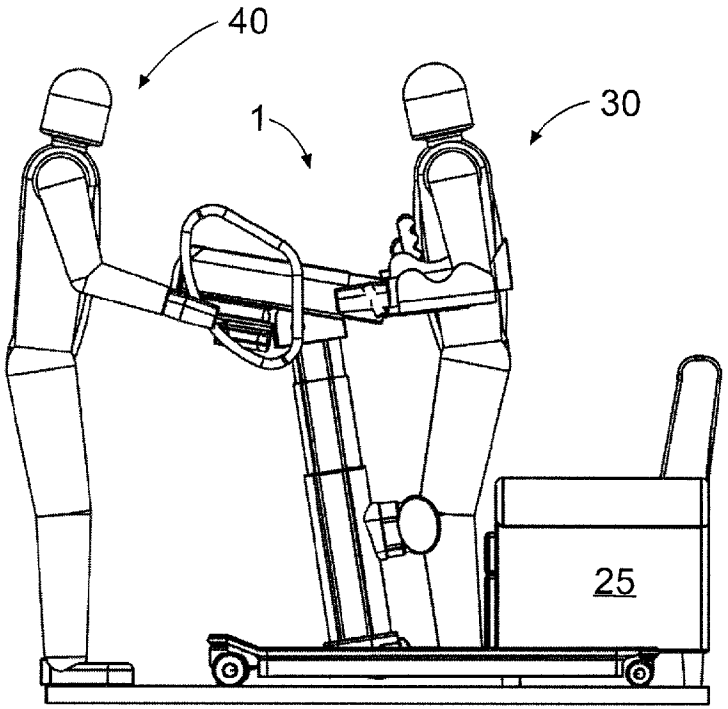
FIG. 19 illustrates the interaction between an operator, the apparatus according to FIG. 1 and a user of the apparatus.

With reference to FIG. 19 the upright position of the person to be assisted 30 is shown together with an operator.

Figure 20C:
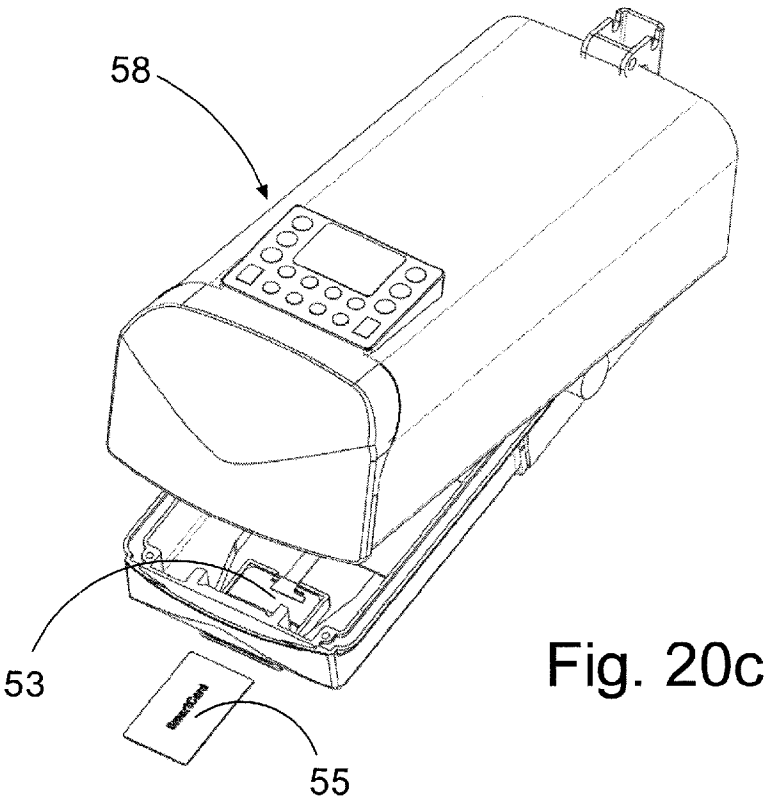
FIGS. 20*b* and 20*c* are elevated views of a portion of the user interface of the apparatus according to FIG. 1.
Figure 20B:
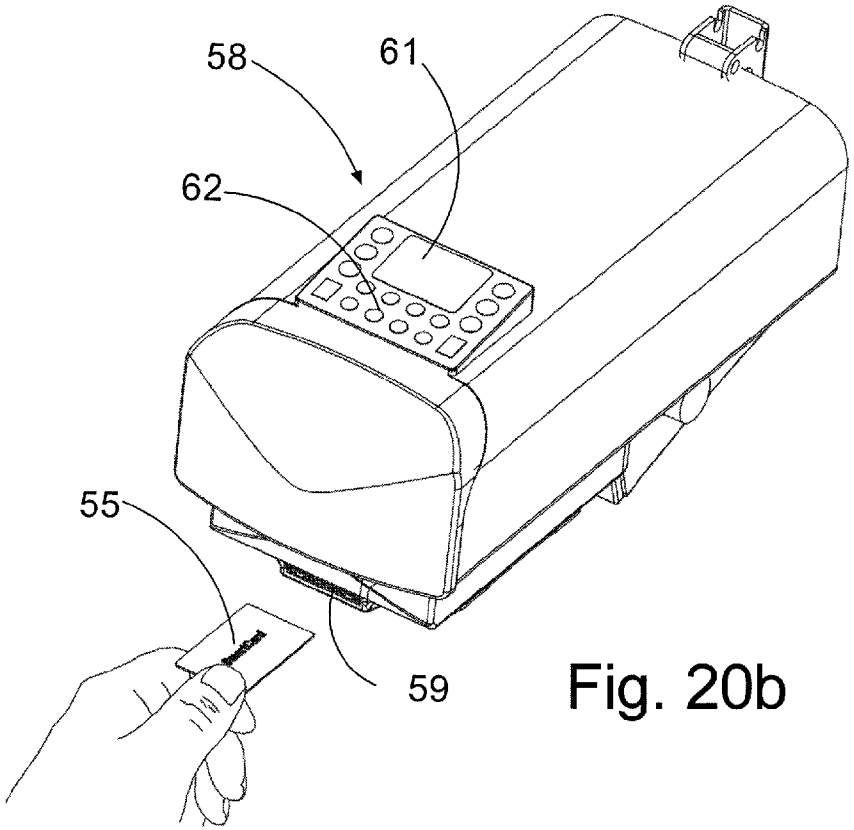

With reference to FIGS. 20*b* and 20*c* a chip card reader 53 is provided at the end of the horizontal column 7 and a chip card 55 is also shown. The chip card reader is connected to a processor in the apparatus 1. The chip card 55, also called smart card or integrated circuit card (ICC) is a pocket-sized card with embedded integrated circuits. The smart card 55 contains information for identifying the person to be assisted. The smartcard may also have stored thereon other data relating to the person to be assisted, such as the desired movement profiles and/or anthropometric data and degree of disability. The desired movement profile may have been stored on the card before the chip card 55 has ever been used with the apparatus 1. Alternatively, a desired profile can be generated by the apparatus 1 or selected from a plurality of profiles stored in the apparatus 1 and transferred to the chip card 55. The chip card 55 can be used with more than one apparatus 1, so a profile stored on the chip card 55 can be used the first time that a person uses one of the apparatuses 1 that has not yet stored the person's profile in its memory. Also when the profile has changed, the changed profile stored on the chip card 55 is transferred to any apparatus 1 that is not aware of the changed profile.

In an embodiment the electronic system of the apparatus 1 includes a short range wireless adaptor (e.g. Bluetooth) and/or a near field sensor (RFID) for communication with a device holding data of the person to be assisted such as a smartcard or mobile telephone or other suitable device provided with a chip or a near field tag.

The apparatus 1 is also provided with a separate keyboard 62 that is provided with a plurality of buttons or another input means, such as a touchpad. In an embodiment the keyboard also includes a display 61 for data feedback to the operator 40. The keyboard 62 and the display 61 are connected to the processor.

In an embodiment, identification of the person to be assisted is effect via a code or password assisted with the person to be assisted using the keyboard 62.

In an embodiment the apparatus 1 is provided with a display that is placed such that it is in sight of the person to be assisted 30.

Figure 21B:
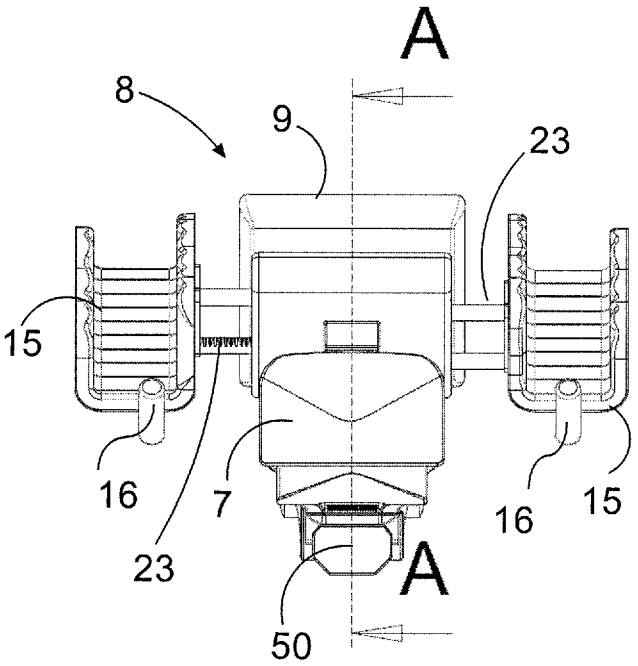
FIG. 21*b* is a front view of the top column actuator, torso support and armrests of the apparatus according to FIG. 1.

FIG. 21*b* is an end view of the horizontal column 7 and the torso support 8 showing in greater detail the configuration of the armrests 15 and the construction suspending the armrests from the torso support. The distance between the torso support 8 and the armrest 15 can be adjusted through a mechanism that involves teeth in the rods 23 that project from the frame behind pillow 9 and allow the armrests 15 to engage in various positions with various distances to the pillow 9. The armrests 15 can also be adjusted in the direction of the longitudinal extent of the horizontal column 7 by a mechanism such as e.g. using concentric rods.

Figure 21A:
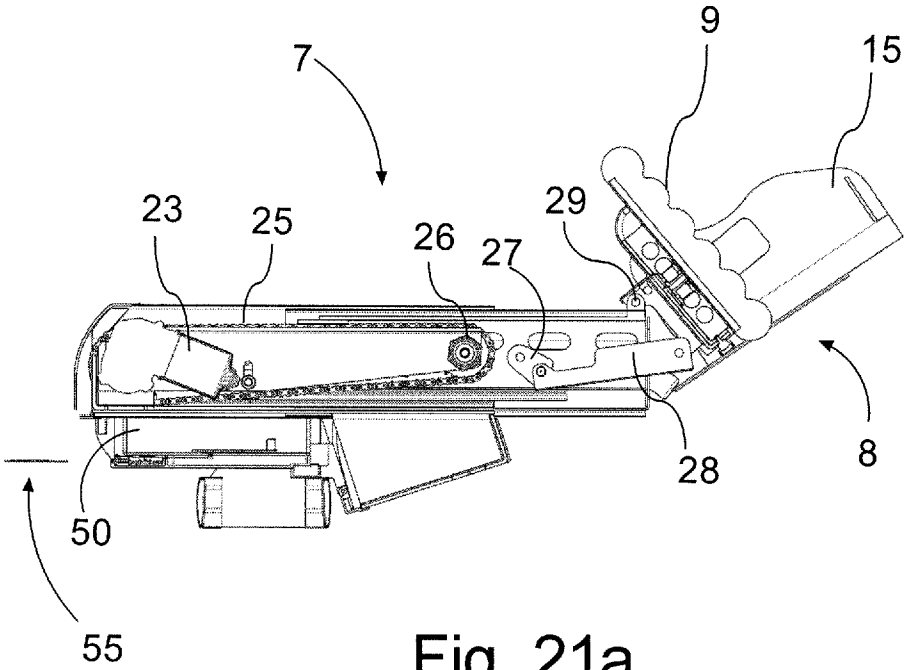
FIG. 21*a* is a sectional view of the top column actuator and torso support of the apparatus according to FIG. 1.

FIG. 21*a* is a sectional view that illustrates the rotational actuator for rotating the torso support 8 about a pivot pin 29. The longitudinal axis of the pivot pin 29 coincides with the axis A in FIG. 8. The rotational actuator for rotating the torso support 8 is arranged inside the horizontal column 7 and includes a drive motor 23 that includes a reduction gear, a chain 25 and a sprocket 26. The drive motor 23 is connected to a sprocket (not shown) that engages the chain 25 and chain 25 drives the sprocket 26. Sprocket 26 is connected to another gear that drives an arm 27. The arm 27 is pivotally connected to an extremity of a link 28 and the other extremity of the link 28 is connected pivotally to the torso support 8. When the drive motor 23 is activated in one of its operating directions the torso support 8 is rotated in an anticlockwise movement as seen in FIG. 21*a* and when the drive motor 23 is operated in the opposite direction the torso support is rotated a clockwise movement in as seen in FIG. 21*a*.

Figure 21C:
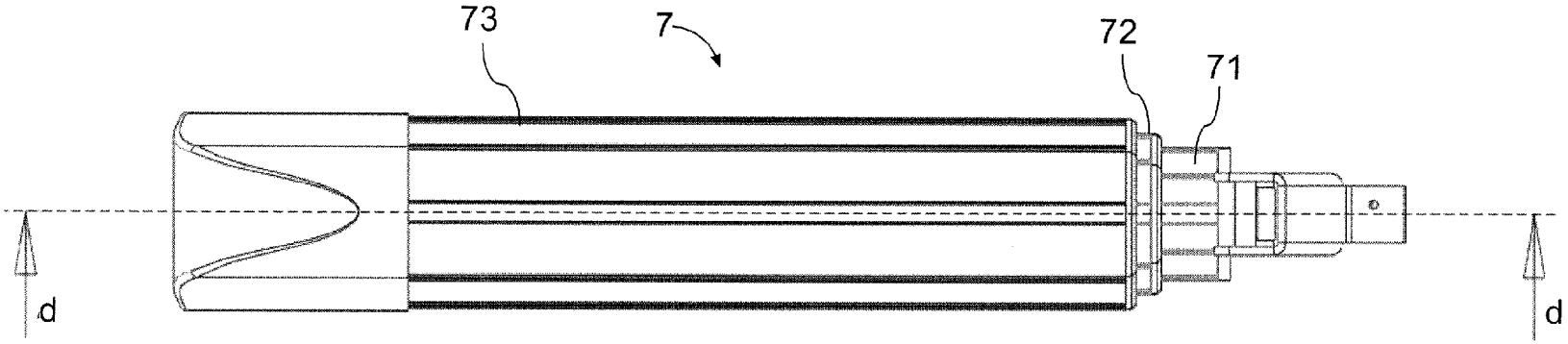
FIG. 21*c* is a top view of another embodiment of the top column actuator of the apparatus according to FIG. 1.
Figure 21D:
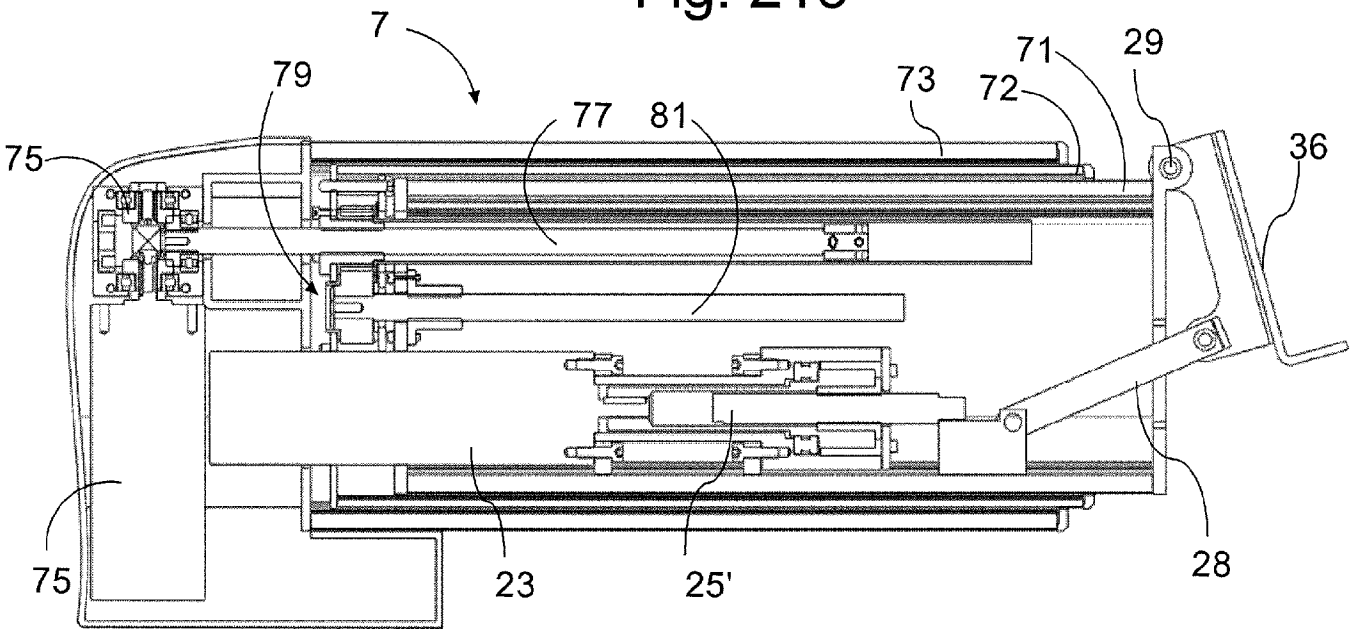
FIG. 21*d* is a section view of the top column actuator, shown in FIG. 21*c*

FIG. 21*c* is a top view of another embodiment of the top column actuator 7. FIG. 21*d* is a section view of the top column actuator, shown in FIG. 21*c*. This embodiment of the top column actuator 7 is essentially identical to the embodiment shown with reference to FIGS. 21*a* and 21*b* with identical reference numerals denoting identical components or elements, except that the rotational actuator is has a spindle actuator 25' that is driven by the electric drive motor 23 (including reduction gear) and the free end of the spindle of the spindle drive 25' is connected to the frame via a connection rod 28 that is hingeably attached at its ends to the free end of the spindle of the spindle drive and the frame 36 respectively. The linear actuator arrangement for changing the length of column 7 is described in detail with the same reference numerals further below in the detailed description for FIGS. 26-36.

A rechargeable battery 50/control unit is mounted under the horizontal column 7.

Figure 22:
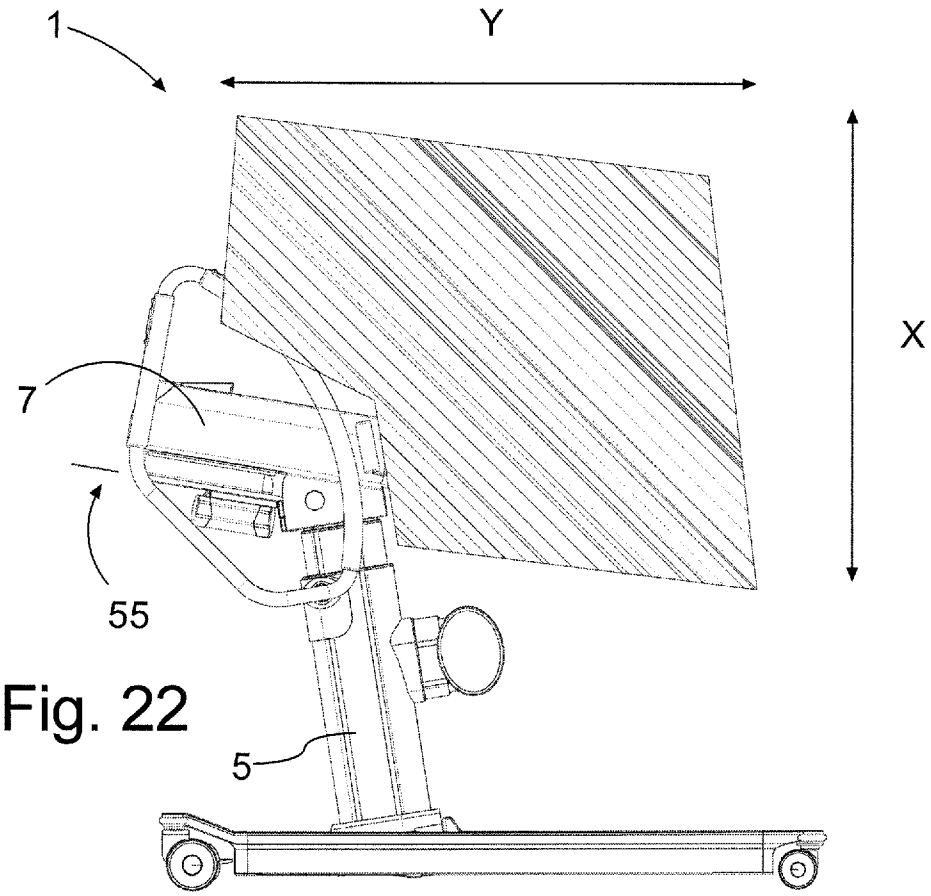
FIG. 22 is a side view of the apparatus according to FIG. 1 illustrating the horizontal and vertical range of the torso support.

FIG. 22 is a side view of the apparatus 1 and the hatched area illustrates the range in the X and Y direction (horizontal and vertical position, respectively) of the torso support 8. Due to the independency of the actuator in the upright column 5 and the actuator in the horizontal column 7, the torso support 8 can take any position within the hatched area and can be moved along any path that can be described within the hatched area under control of the control unit 50 that is operatively connected to the actuators in the respective columns. At the same time, the rotational actuator for the torso support 8 can be operated individually and independently from the horizontal and vertical actuators and therefore the torso support 8 can take any angular position within its range angular positions whilst being in any of the X or Y positions within the hatched area. Also the speed of the horizontal, vertical and rotational actuator can be controlled individually and independently under command from the processor/control unit 50.

Figure 23:
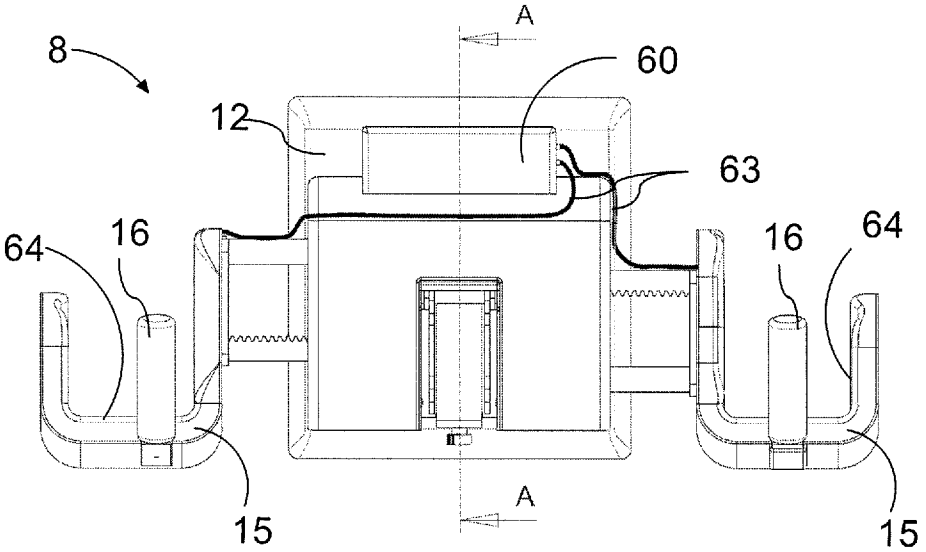
FIG. 23 is a detailed front view of the torso support and the armrests of the apparatus according to FIG. 1.
Figure 29:
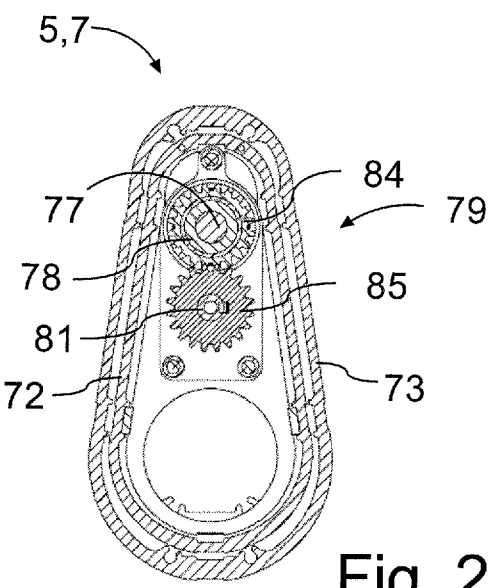
FIG. 29 is a cross-sectional view through the telescopic column actuator along the line C-C' in FIG. 26.
Figure 30:
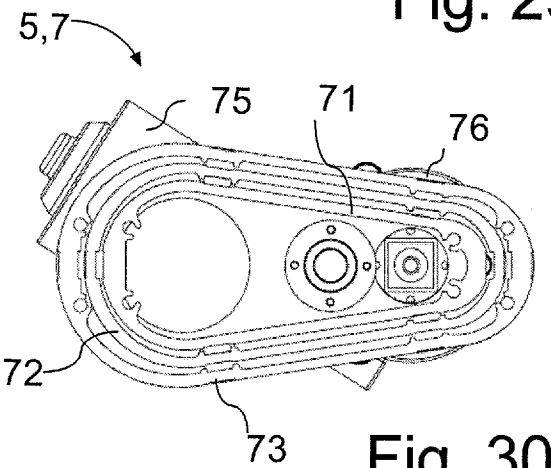
FIG. 30 is an end view on the telescopic column actuator of the apparatus of FIG. 1.
Figure 26:
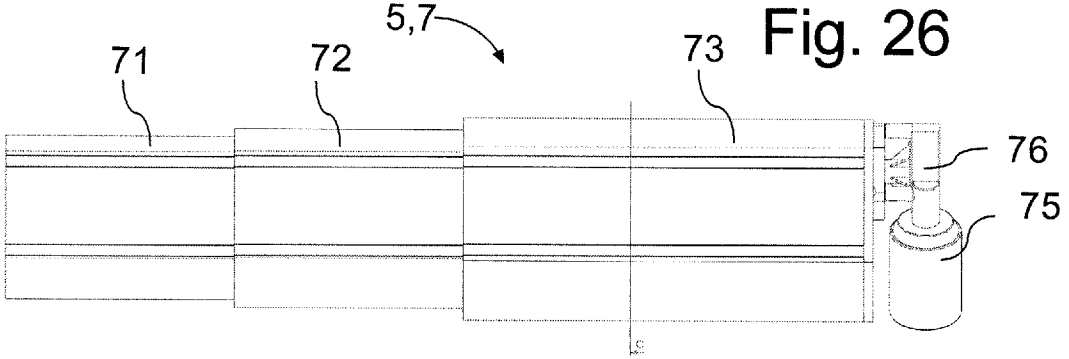
FIG. 26 is a side view of the construction of a telescopic column actuator of the apparatus of FIG. 1.
Figure 27:
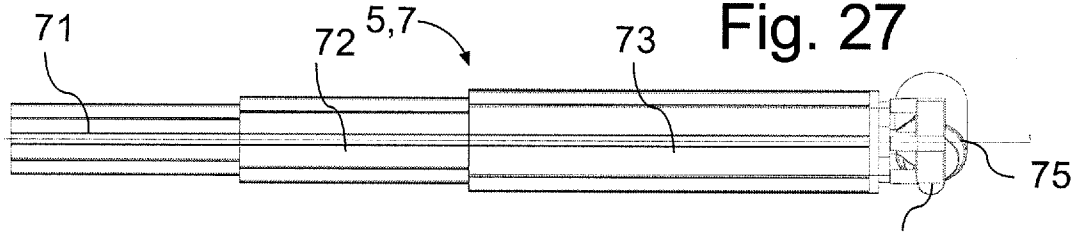
FIG. 27 is a top view of the construction of a telescopic column actuator of the apparatus of FIG. 1.

FIG. 23 is an end view on the torso support 8, illustrating the vacuum pump 60 and tubes 63 that connect the vacuum pump to bladders that are arranged under the lining in the armrests 15.

Figure 24:
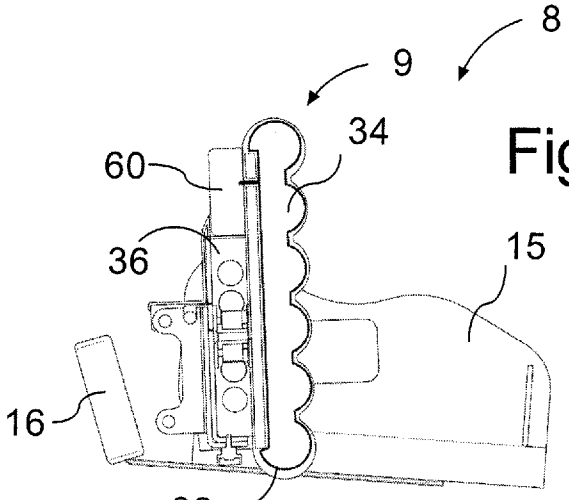
FIG. 24 is a detailed cross-sectional side view of the torso support of the apparatus according to FIG. 1, with a torso support pillow in a default configuration.
Figure 25:
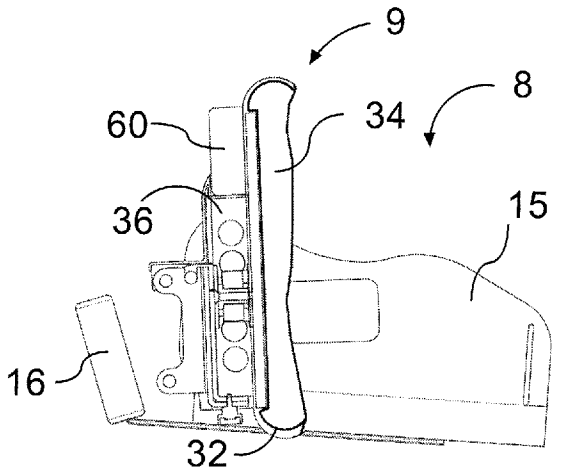
FIG. 25 is a detailed cross-sectional side view of the door support of the apparatus according to FIG. 1, with the torso support pillow in a configuration that is adapted to the shape of the chest of the person to be assisted.

FIGS. 23 to 25 show the pad or pillow 9 that forms the chest engagement surface of the torso support 8 in greater detail with FIGS. 24 and 25 being cross sectional views along the line A-A in FIG. 24. The pad or pillow 9 is secured at its rear side to a frame 36 with its front side arranged to face the chest of the person to be assisted. The pad or pillow 9 has an outer surface material or lining of fabric or leather material that surrounds a bladder 32 that has a filling 34 consisting of a very large number of very small spheres, preferably plastic foam spheres. The bladder 32 is connected to a vacuum pump that is connected to the controller 50. When the vacuum pump 60 is active the bladder 32 shrinks and presses the small plastic foam spheres together and thereby freezes the shape of the pillow 9 at the moment of applying vacuum since the spheres are not freely movable when they are pressed together. When the vacuum pump 60 is deactivated the pressure inside the bladder 32 returns to atmospheric and the pillow 9 becomes pliable again because the small plastic foam bubbles are no longer pressed together. During operation, the person to be assisted 30 engages the pillow 9 with his/her chest while the vacuum pump is not active and the shape of the pillow easily adapts to the shape of the chest of the person to be assisted 30. Just after the person to be assisted 30 has engaged in the pillow 9, the vacuum pump is activated in the shape of the pillow 9 is frozen, so that its shape cannot be easily changed any longer and thus the person to be assisted 30 is comfortably but also securely engaged by the torso support 8 and ensures that the person to be supported is not likely to move relative to the torso support 8 whilst the vacuum is applied to the pillow 9. The vacuum in the bladder 32 is maintained during the assisting operation and atmospheric pressure is only allowed after the assisting operation is ended.

Thus, a pillow 9 is provided that is configured to have a pliable state in which the pillow 9 can adapt its shape to the shape of the chest of a person to be supported and a state wherein the shape of the pillow 9 is unpliable so that the pillow can maintain its shape for supporting the person to be supported.

The interior lining of the armrests 15 is also provided with a pillow that can be frozen in a given shape caused by the parson to be assisted applying pressure when it is in the pliable state. A bladder filled with a large number of small spheres (not shown) is provided under the lining of each armrest 15. These bladders are connected to the vacuum pump 60 via tubes 63. The operation of the bladders in the armrests 15 is essentially identical to the operation of the bladder 32, with vacuum being applied after the person to be supported has engaged the armrest in order to lock/freeze (render non-pliable) the padding in the armrest in a comfortable shape that supports the arms of the person to be supported. In an embodiment these is a switch valve (not shown) arranged between the vacuum pump 60 and the bladders so that vacuum can be applied to the respective bladders independently from one another.

The knee support 11 may in an embodiment be provided with pillows/engagement surfaces with the same characteristics as the chest pillow 9, i.e. with a capacity to assume a pliable state in which the person to be assisted engages the knee support and shapes it and a non-pliable or frozen state that is applied thereafter during a movement.

Figure 28:
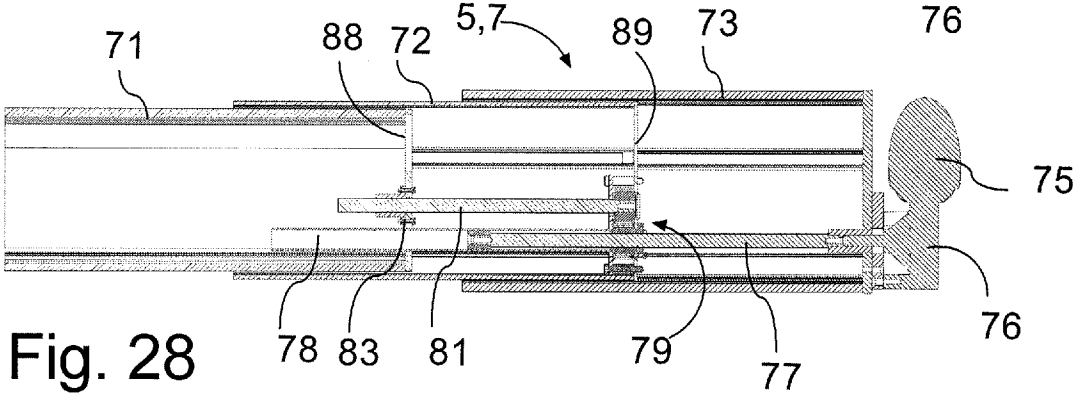
FIG. 28 is a sectional side view of the construction of a telescopic column actuator of the apparatus of FIG. 1.

With reference to FIGS. 26 to 30 the construction of the columns 5 and 7 and the linear actuator arranged therein is described. FIG. 28 is a cross-sectional view along the longitudinal extend of the column 5,7 and FIG. 29 being a classic cross-sectional view. The column is constructed from 3 telescopically arranged sections 71,72,73 with section 71 in this embodiment being concentrically the innermost and longitudinally the distal section, with section 72 being concentrically and longitudinally the middle section and section 73 being concentrically the outermost and longitudinally the proximal section. The sections 71,72,73 are tubular with a tapered oval sectional outline. The sections 71,72,73 are in an embodiment made from a metal material, preferably an aluminum alloy. An electric drive motor 75 that is formed as one unit with a reduction gear 76 is arranged at the free end of section 73. The output of the reduction gear 76 is connected to a spindle 77 of a first spindle drive. The nut of the first spindle drive is formed by a tube 78 that is secured to a proximate end wall 89 of section 72. A gearwheel 84 that is concentric with the spindle 77 is rotationally secured to spindle 77 by a groove and nut or other suitable arrangement but the gearwheel 84 is axially secured to the end wall 89 and not axially secured to the spindle 77 so that the gearwheel 84 rotates in unison with the spindle 77 but is axially static. The gearwheel 84 meshes with another gearwheel 85 that is rotationally suspended from the end wall 89. Gearwheel 85 is rigidly connected to a spindle 81 of a second spindle drive, so that the gearwheel 85 and the spindle 81 rotate in unison and are both axially non-displaceable relative to the end wall 89. Spindle 81 is in treaded engagement with a nut 83 that is secured in a proximate end wall 88 in section 71. Tube 78 is slidably received in a hole in end wall 88. When the drive motor 75 is activated spindle 77 is rotated and spindle 77 rotates spindle 81 via the gearwheels 84,85. Due to the threaded engagement with the tube 78 spindle 77 axially displaces the middle section 72. Due to the threaded engagement with the nut 83 spindle 78 axially displaces the distal section 71 simultaneously. Thus, a "tandem" or "serial" spindle drive is formed. The serial spindle arrangement ensures that the sections are displaced telescopically in a simultaneous fashion. Changing the rotational direction of the electric drive motor 75 changes the direction of displacement of the sections 71,72.

Figures 31, 32, 33:
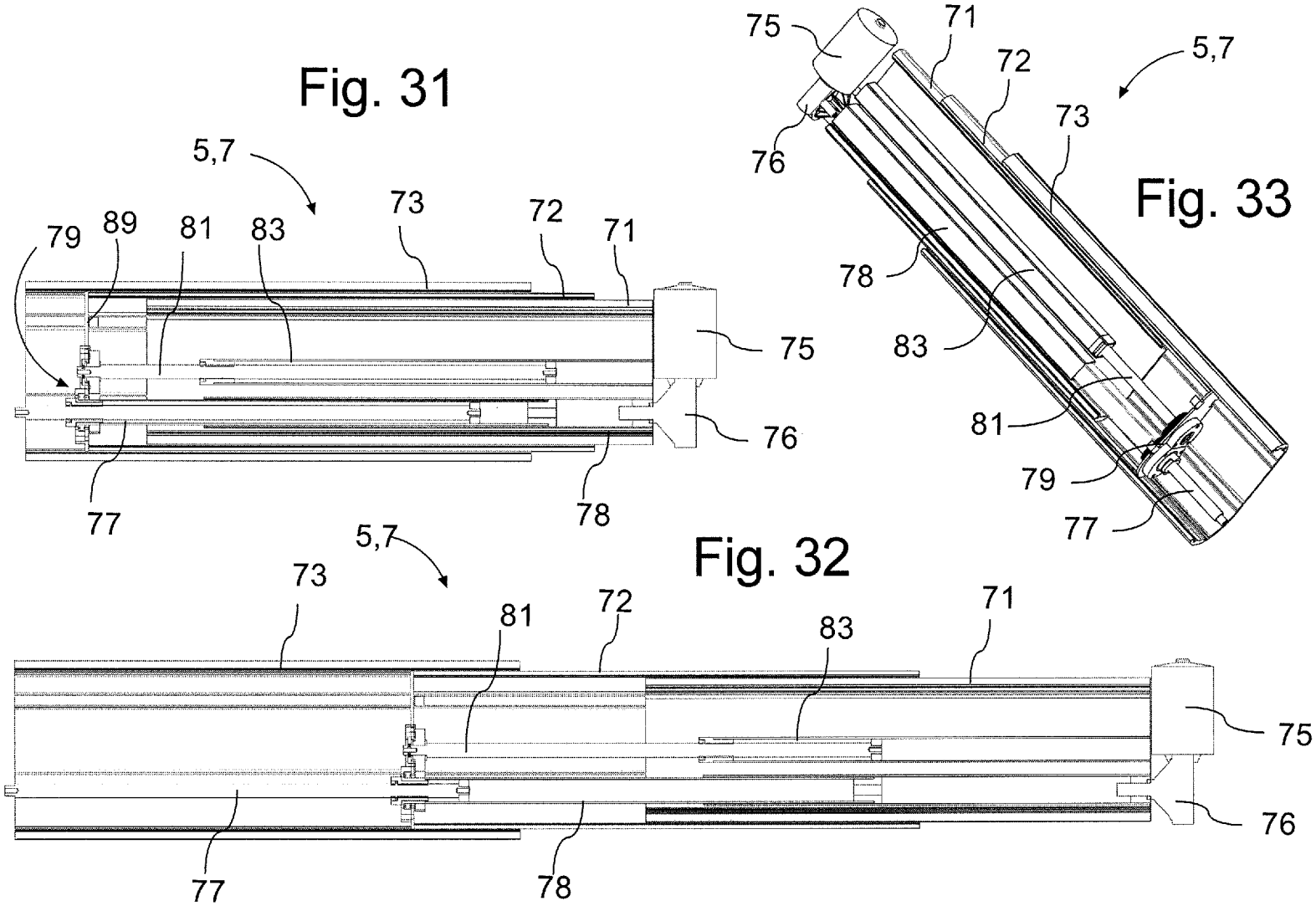
FIG. 31 is a longitudinal-sectional view of another embodiment of the a telescopic column actuator for the apparatus of FIG. 1 in a retracted position.
FIG. 32 is the same view as FIG. 31 with the telescopic column actuator in an extended position.
FIG. 33 is a another elevated sectional view through the telescopic column actuator for an apparatus of FIG. 1.

FIGS. 31 to 33 show another example embodiment of the construction of the column 5,7. This embodiment is similar to the embodiment described here above, and includes the same three sections 71,72,73 that are arranged concentrically and telescopically. However, in this embodiment the electric drive motor 75 and reduction gear 76 are secured to section 71 and the drive motor rotates a tube 87 around a static spindle 77 that is secured to a distal end wall 89 of section 72. The distal end wall 89 is also the substrate to which a gear arrangement 79 is secured. The tube 78 is in threaded engagement with the stationary spindle 77 of a first spindle drive. The gear arrangement 79 transmits rotation of tube 78 to a spindle 81 of the second spindle drive. The spindle 81 is in threaded engagement with a tube 83 that is connected to section 71. Thus, a "tandem" or "serial" spindle drive is formed. The serial spindle arrangement ensures that the sections are displaced telescopically in a simultaneous fashion. Changing the rotational direction of the electric drive motor 75 changes the direction of displacement of the sections 72,73.

Figure 34:
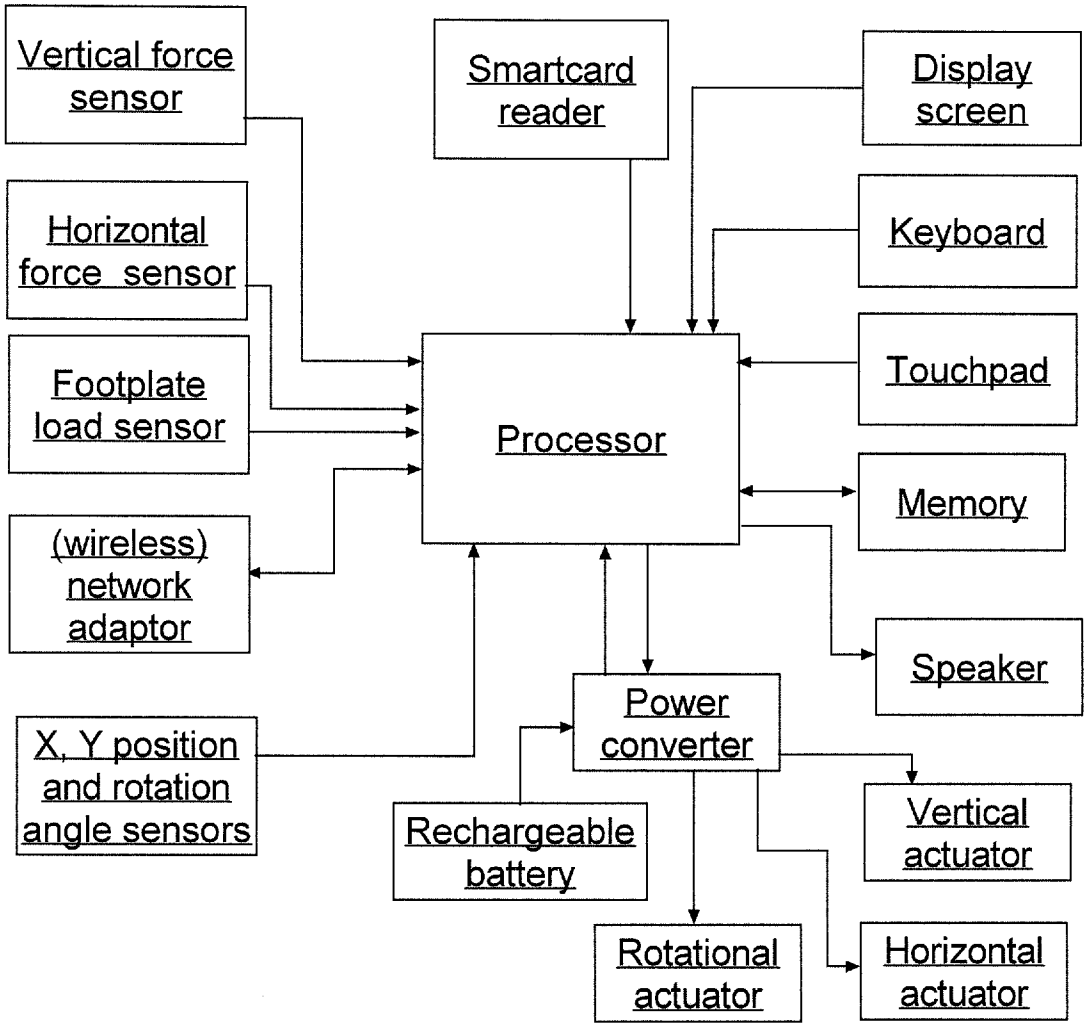
FIG. 34 is a block diagram of the electronic control system of the apparatus of FIG. 1.

FIG. 34 shows a block diagram of the electronic system of the apparatus 1. The heart of the electronic system is a processor. The poser supply of the electronic system is a rechargeable battery. A power converter is connected to the rechargeable battery and the power converter is controlled by the processor. The electric drive motor of the rotational actuator, the electric drive motor of the horizontal actuator and the electric drive motor of the rotational actuator are connected to the power converter and can be individually controlled by the processor. A memory, that may be formed by several different types of memory devices is also connected to the processor and contains software and programs for the operation of the processor and data for use by the processor. In an embodiment the electronic system also includes a network adaptor, preferably a wireless network adaptor for communication with a remote server or operator. The electronic system may also include a short range wireless adaptor (e.g. Bluetooth) or a near field sensor (RFID) for communication with a device holding data of the person to be assisted such as a smartcard or mobile telephone. The user interface is formed by a speaker, a touchpad or touchscreen or keypad and conventional display screen and a smartcard reader that are all connected to the processor for input of instructions or data to the processor. X,Y (horizontal and vertical position) sensors and a rotation angle sensor are also connected to the processor. Further, sensors for registering the force that the person to be supported exercises onto the torso support 8 in both X and Y direction are connected to the processor too. In an embodiment there are separate sensors for force on the one armrest and on the other armrest 15. In yet another embodiment there is a sensor connected to the processor for registering the force applied by the person to be supported to the footplate too.

The lifting movement is individually tailored to the person to be supported and mimics the natural movement pattern. People get up by moving the center of gravity of the body over a pivot position formed by the ankle joint. This has been the way to stand up since man stood up on two legs. In an embodiment the knee support is movable and follows the knee movement in the horizontal plane.

This individual movement is to be stored on a personal Smart Card, so as to achieve the same movement pattern and speed for each support movement/transfer.

By using sensors at selected locations on the lift it is possible to measure and visualize the participation of person to be supported him/herself in the lifting procedure, and this is a motivator to participate more. These participation data are to be stored on the smart card for use by health professionals during the evaluation of use the equipment by the person to be supported.

Everyday rehabilitation functions can be performed with a training program for a person to be supported, wherein the Smart Card is programmed for exercising the person to be supported e.g. training leg muscles to get up and stand in the apparatus and then running the lift automatically slightly down and up again a number of times. The lift has monitoring methods to visualize the person to be supported's active participation in the transfer. These measurements are logged and will be used for evaluation of the person to be supported's ability to use the apparatus.

Movement Procedure

When a person to be supported is to be assisted with the daily transfers there is usually a therapist or professional movement assistant associated with this evaluation. There will be an evaluation of the person to be supported's ability to use the apparatus.

A software program is designed to fulfill the initial need to create a profile of the person to be supported, to create an initial profile.

Based on the data of to the person to be supported and an "experience algorithm", the software creates a custom profile that is encoded in the person to be supported's Smart Card. This movement profile is to be tested and adjusted accordingly until it is deemed to match perfectly to the person to be supported's movement pattern. The Smart Card collects information for this first transfer which could be used for an initial assessment on whether the movement is optimal for the person to be supported. An algorithm exists to achieve optimal transfer, based on the different measurements.

Software

Recording data from the lift to the Smart Card.

On the lift are sensors measuring the person to be supported's ability to help in the transfer and balance. These measurements are stored on the Smart Card to be used for future evaluation of the person to be supported. The software displays in an easy-to-read manner the development of the person to be supported, in order to take the right routines. This is very important because the person to be supported may on the one hand be too weak to be able to use the lift, or may have improved to the point that there is no need for the equipment.

A cloud computing storage system supports the "Experience Database". The software has broad functions:

- To handle individual person to be supported's data (record keeping)
- To guide operator or therapist in selecting an optimum movement pattern for person to be supported
- To retrieve data from the Smart Card to determine the movement profile.
- To receive data from the apparatus.
- To store data and compare data:
- Profile, record keeping, input:
  - Unique personal identity
  - Person to be supported's name
  - Address
  - Date of birth
  - "Impairment" description (ex. half side paralysis, decreased muscle strength)
  - Height
  - Weight
  - Step height
  - Abdominal circumference
  - Ability to stand rating, e.g. rated from 1 to 5
  - Speed e.g. selected from 1 to 5

Based on these data and an algorithm (said algorithm is made on the basis of user testing and experience from therapists) the software suggests a movement and speed that can be described in terms of a set of data parameters, which is stored in memory on the smart card.

The operator can also select the algorithm in a common experience base formed by voluntary reports from other users of the system. The "Experience Database" will be able to contribute experience where users can comment and "rate" the movement patterns available in the database.

Smart Card data:

Parameters loaded on the card with a known standard e.g. ISO/IEC 7816, or 7816-3

Parameters:

Unique personal identity

Person to be supported's name

Date of birth

Movement Data

Data collection from the lift to the Smart Card:

Sensors on the lift will monitor the weight distribution and provide measurements back on the map. The measurements are e.g., weight distribution foot/arm at the start, half standing and full standing position.

Time stamp for each transfer

Loading data from Smart Card:

All data is loaded from card to memory

An "evaluation" algorithm looks at data and provides a graphical overview of the number of transfers and person to be supported's skills.

The software includes code for storing data and comparing data:

All data stored in the local database of person to be supported's records and associated comments Data and comments. Shared experience data base (personal data will not be shared)

The software includes also code for collecting data from the lift to the Smart Card:

Sensors on the lift will monitor the weight distribution and provide predetermined measurements back on the map. The measurements can for example be, weight distribution foot/arm at the start, half standing and full standing position.

Time stamp for daily transfers

Figure 35A:
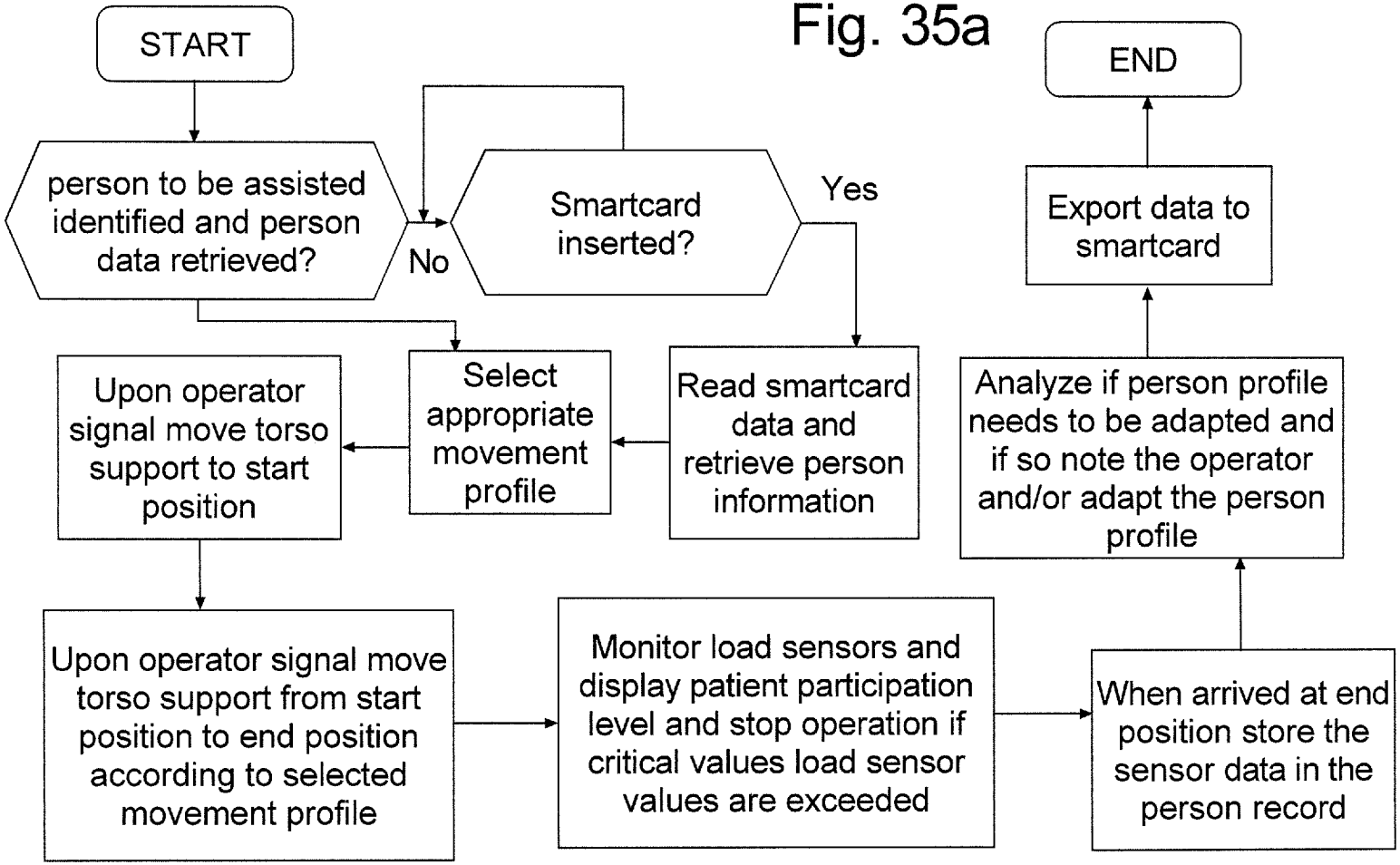
FIG. 35*a* is a flowchart illustrating the apparatus of FIG. 1.

This software in the memory comprises program code for the processor to carry out a support movement. The block diagram in FIG. 35*a* represents an example embodiment of program code for controlling the assisting procedure, i.e. a movement such as a movement from a sitting position to a standing position of a person to be assisted, or vice versa. At the start of the procedure, the program code instructs the processor to verify that the identity of the person to be assisted is known and if the identity of the person to be assisted is not known the program code instructs the processor to check if a smart card 55 is inserted into the smartcard reader 53. If no smartcard 55 is inserted into the smartcard reader 53 the program code will instruct the processor to await the insertion of a smart card 55. When a smart card 55 is inserted the program code instructs to processor to read to the data on the smart card 55 and to retrieve the information related to the identified person.

Figure 35B:
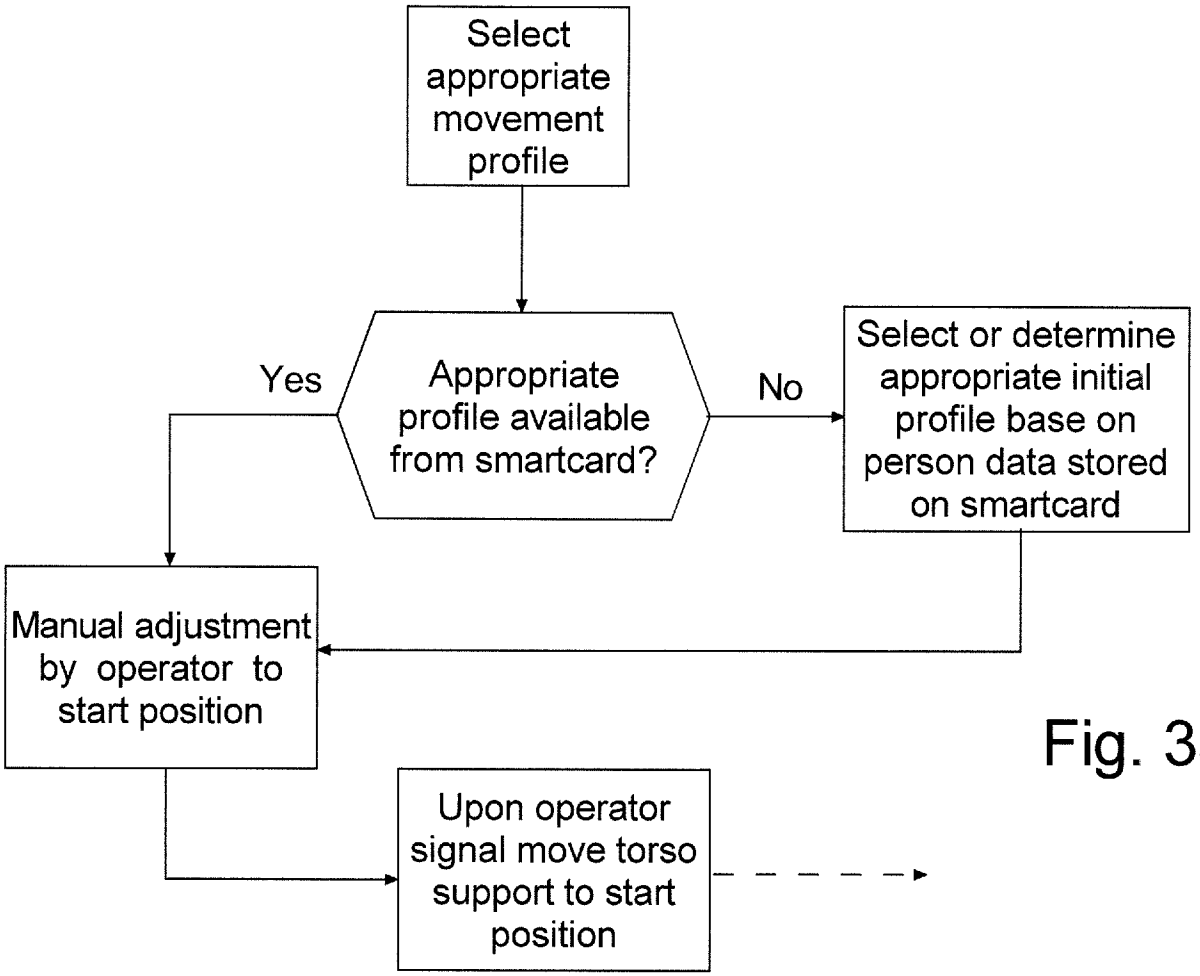
FIG. 35*b* is a detail of the flowchart of FIG. 35*a*.

If the identity of the person to be assisted was known at the start of the procedure, the program code instructs the processor to move directly to the step of selecting an appropriate movement profile. The program code also instructs the processor to select the appropriate movement profile after the identity of the person has been retrieved from the smart card 55. In an embodiment, the appropriate movement profile is stored on the smart card. The details of the initial profile selection when an appropriate profile is not yet available for the person to be assisted are illustrated in FIG. 35*b* and include selecting the an initial profile from a set of default profiles or determining calculating and initial profile, in both cases based on the characteristics of the person to be assisted. After selection of the appropriate movement profile the movement profile the processor awaits a signal from the operator to move the torso support 8 to a start position. After the processor has instructed the linear actuators and rotational actuators to move to the start position, the programming code gives the operator an opportunity to make manual adjustments to the start position of the torso support 8 by using the buttons 58 on the handlebars 19, for e.g. adapting to a lower chair or bench that the person to be assisted is sitting on. Next, the programming code awaits the signal from the operator (inputted via the user-interface) and upon receipt of this signal the processor commences the assisting movement in accordance with the selected movement profile. During the moving operation, the program code instructs the processor to monitor the load sensors and to display patient participation level and stops the operation if critical values measured by the load sensors are exceeded. In an embodiment the participation by the person to be supported is displayed as positive when the ratio between the load on the footplate and the load on the torso support is higher than a threshold. In an embodiment there are several thresholds, each related with a different level of participation by the person to be supported. In an embodiment the thresholds are variable in relation to the position of the torso support, i.e. the threshold varies with the position of the torso support.

Figure 35C:
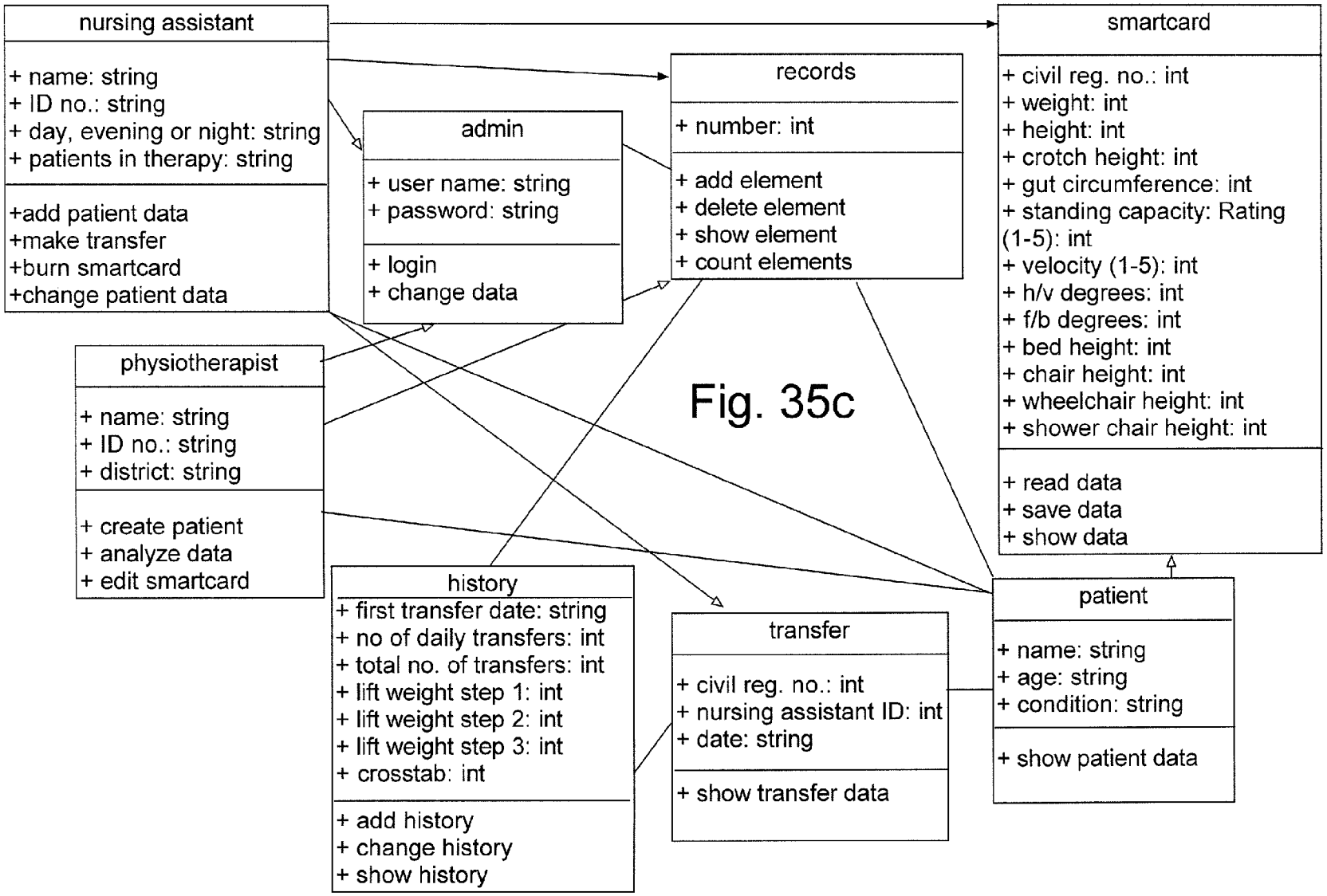
FIG. 35*c* is an operational diagram.

FIG. 35*c* is an example embodiment of a system diagram showing the functionalities associated with the various elements of the system associate with the apparatus 1,101. The following information is associated with a nursing assistant: name, ID no., time: day, evening or night and patients in therapy. The nursing assistant is allowed to add patient data, to make a transfer, to burn a smartcard and to change patient data. A physiotherapist has associate with him/her: a name, an ID no. and a district. The physiotherapist is allowed to create a patient, to analyze data and to edit a smartcard.

The administrator of the system is allowed to create user names, reset passwords, access login data and to change data stored in the system.

Records are associated with the system and e.g. stored on a drive other type data storage of a server. Records are enabled to have added elements, delete elements, show element and count elements.

The history of transfers (movements) is stored in the records, including first transfer date, no. of daily transfers, total no. of transfers, lift weight step, lift weight step 2, lift weight step 3 and contingency table. The history can be added, changed or shown.

Transfers have associate therewith civil reg. no. (e.g. social security number), the nursing assistant ID and the Date of the transfer and the transfer details can be shown.

The smartcard has stored thereon civil reg. no., weight, height, crotch height: gut circumference: standing capacity: Rating (1-5), velocity (1-5): h/v degrees, f/b degrees, bed height, chair height, wheelchair height, and shower chair height. The data can be read, save and shown.

The patient (person to be supported) has associated with him/her: name, age and condition.

Figure 35D:
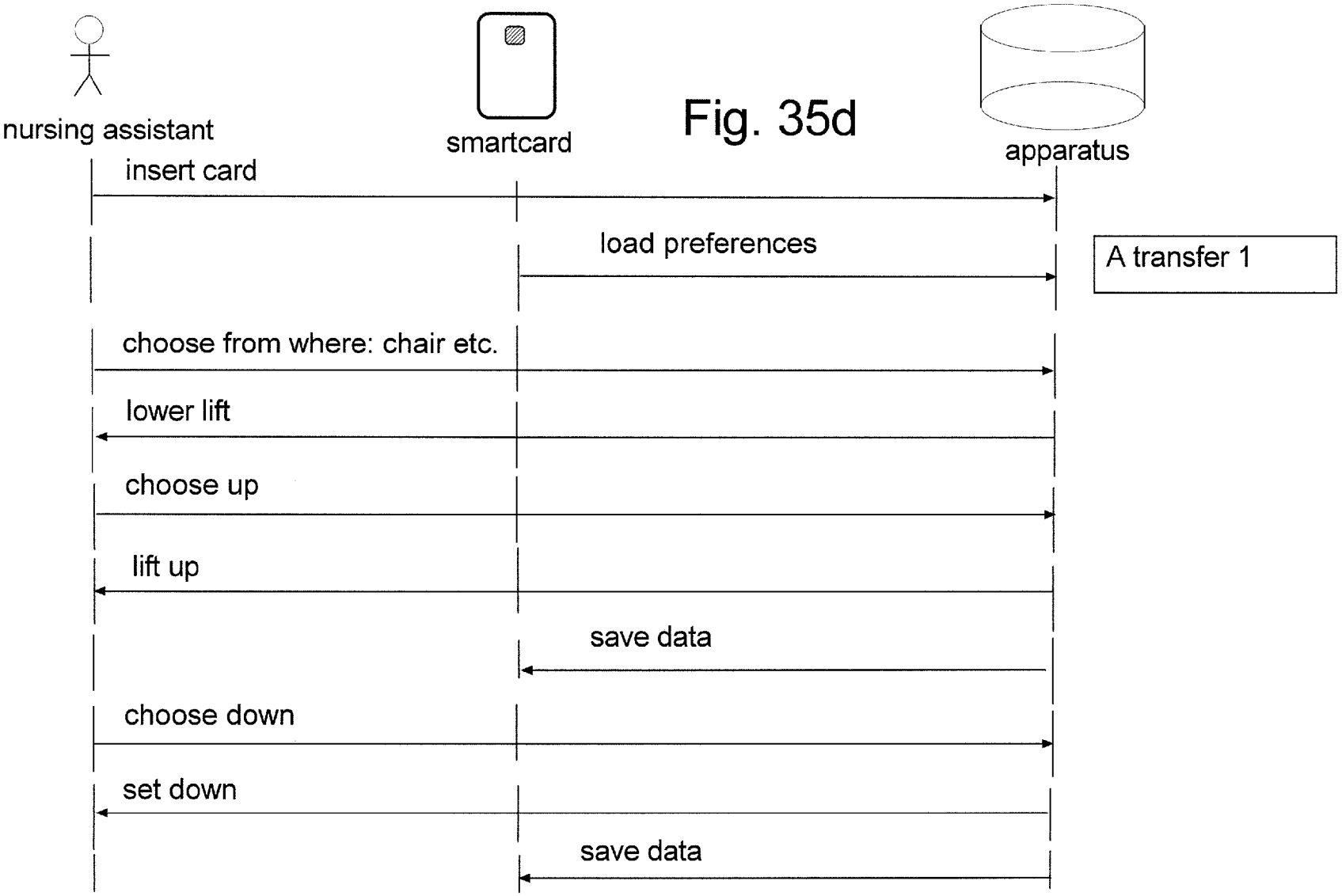
FIG. 35*d* is another operational diagram.

FIG. 35*d* is a simplified diagram of an example embodiment for the operation of the apparatus. At the start of operation the nursing assistant inserts the smartcard into the smartcard reader of the apparatus. The load preferences (movement profile) are then transferred from the Smart card to the apparatus. In the next step the nursing assistant chooses where the transfer starts from, for example from a chair or from a toilet.

Thereupon the apparatus lowers the torso support to the start position. When the person to be assistant has been secured to the torso support the nursing assistant chooses the "up" command and the apparatus moves the torso support up to the desired height for the standing position as indicated in the movement profile associated with the person to be assisted. Next, the apparatus saves the data associated with the performed transfer to the smartcard. As a next step the nursing assistant may choose to lower the apparatus and selects the "down" command. Thereupon, the apparatus lowers the torso support to return it to the start position. When this transfer is complete the apparatus transfers the data associated with the performed transfer to the smartcard.

The program code instructs the processor to stop the operation when the torso support has arrived at the end position, where after the programming code inserts to processor to store the sensor data captured during the support movement in the person record of the supported person. The sensor data include in an embodiment the person participation level. As a next step, the program code instructs the processor to analyze the need to adapt or improve the person profile and if necessary the processor will inform the operator of the need to adjust the person profile. Then, the assisting movement is completed and the program ends.

Figure 38:
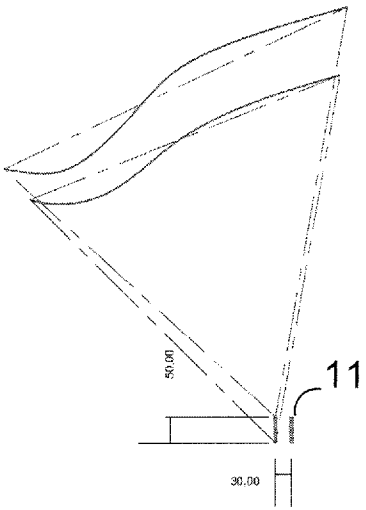
FIG. 38 illustrates two movement profiles for persons with different heights for going from a seated position to a half upright position.
Figure 37:
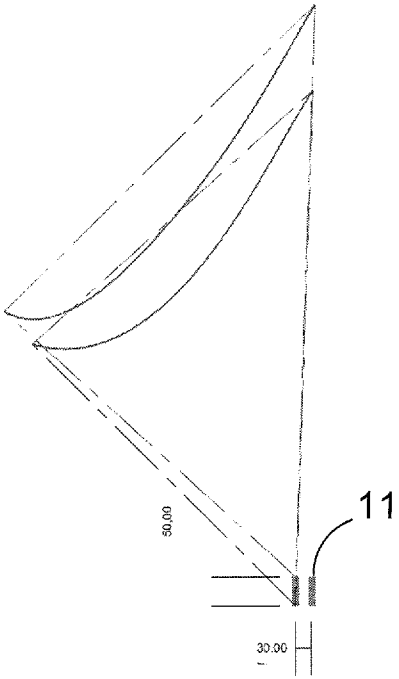
FIG. 37 illustrates two default movement profiles for achieving a standing position.
Figure 36:
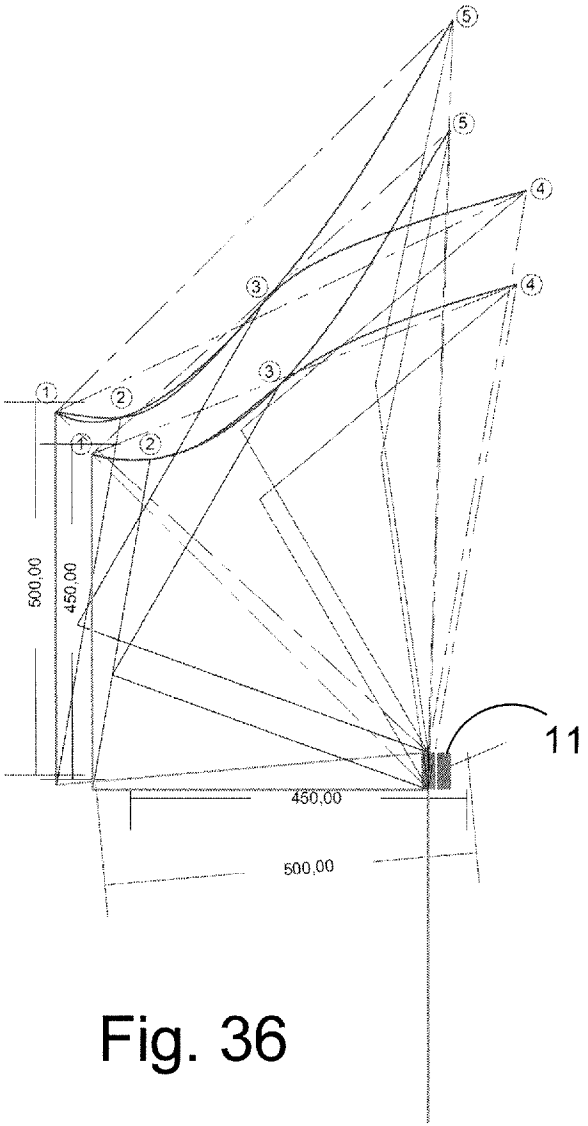
FIG. 36 illustrates a natural movement curve for a person with as used by the apparatus of FIG. 1.

FIGS. 36, 37 and 38 show movement profiles that have been established by assuming that the person to be assisted has his knee joint fixed during the support operation and rotates his upper leg around the knee joint and with the upper leg forming one link of a link mechanism and the upper body of the person to be supported forming another link of a link mechanism with the hip of the person to be supported forming the pivot between the two links. The curves are established by assuming that the center of gravity of the person to be supportive remains above the ankle joint during the movement form sitting to standing and vice versa. The three curves represent persons of 1.7 m and 1.9 height respectively. Curves for persons in between these two values and above and under these two values can be calculated by the processor using tables or equations. These tables or equations involve in an embodiment the length of the thighbone, weight and height of the person. The movement of the knee support 11 is shown by the two positions and the travel of the knee support 11 is in embodiment 30 mm and indicated by the number 30 in FIGS. 37-39. The numbers 450 and 500 indicate for a person of 1.7 m height and for a person of 1.9 m height the length of the thighbone and spine, respectively.

The different curves are calculated for persons of different height assuming a similar distribution of the length of the links formed by the upper leg and by the upper body. Although only three curves for three persons with different heights are shown in FIG. 36, it should be noted that in an embodiment the memory associated with the processor has a much larger number of default movement profiles stored therein for persons of different heights, preferably at evenly spaced increments. The plurality of default movement profiles are stored in a memory associated with the processor as a plurality of default person types. The plurality of person types being distributed over and covering a range of person characteristics and/or traits, such as anthropometric data and degree of disability. The range of person characteristics and/or traits represents the group of persons that are typically using the apparatus for assisting them to move from a seated position to a raised position.

The default profiles can be used for selecting an initial profile for a person to be supported that has not yet used the apparatus. Hereto, the operator or the processor selects a default profile that is closest to the height of the person to be supported. In an embodiment this is achieved by the process of using the person data from e.g. from the smartcard and selecting a default profile that matches the height as stored in the person profile best. FIG. 37 shows two default profiles for achieving a completely standing position and FIG. 38 shows two profiles for persons with different heights for going from a seated position to a half upright position.

Figure 40:
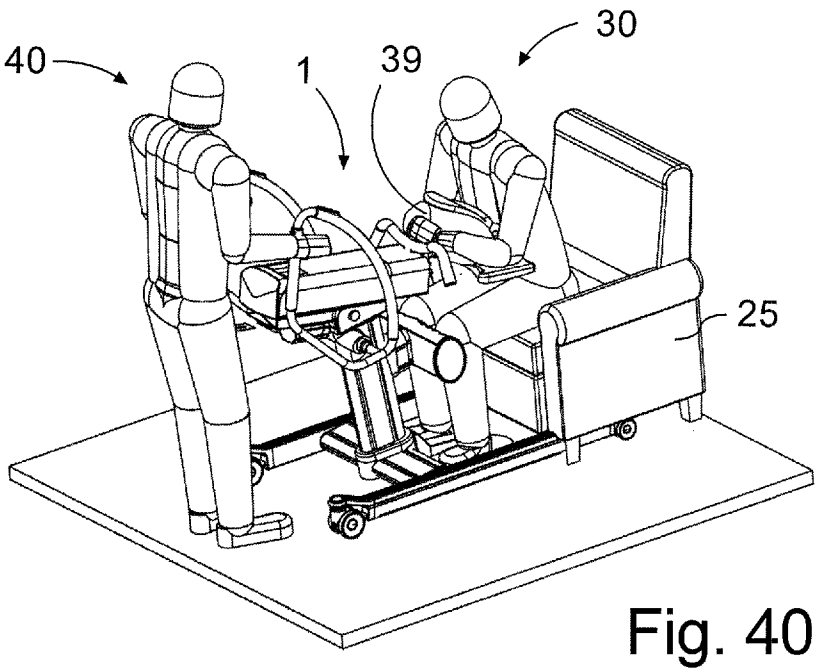
Figure 39:
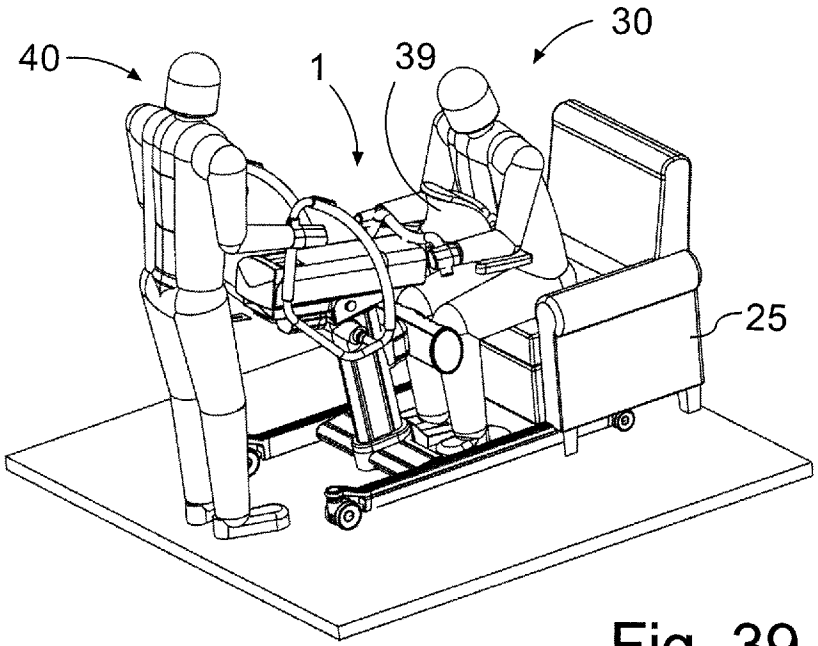
FIG. 39 illustrates the operation of an apparatus according to FIG. 1 with a different type of torso support in which the user claims around the torso support, FIG. 40 further illustrates the operation of FIG. 39.

FIGS. 39 and 40 show another example embodiment of the apparatus 101, that is essentially identical to the apparatus 1 shown with reference to FIGS. 1 to 38, except that the torso support 39 is constructed differently, namely as an object that has to be embraced by the person to be supported, i.e. the person to be supported places his/her arms around the torso support 39. The pillow of the torso support 39 that forms the surface for engaging the chest of the person to be supported can also be provided with a pillow that can be frozen in shape after the person has engaged the pillow, using the technique described above with reference to pillow 9. The torso support 39 according to this embodiment preferably also includes armrests as shown. The operation and construction of the parts of the apparatus 101 other than the torso support are in this embodiment identical to the embodiments described above.

Figure 42:
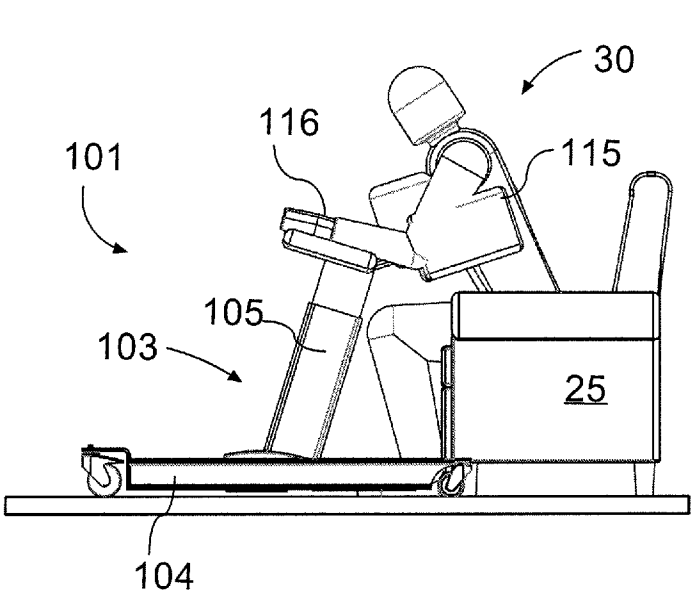
FIG. 42 shows another embodiment of the apparatus for assisting a person.
Figure 41:
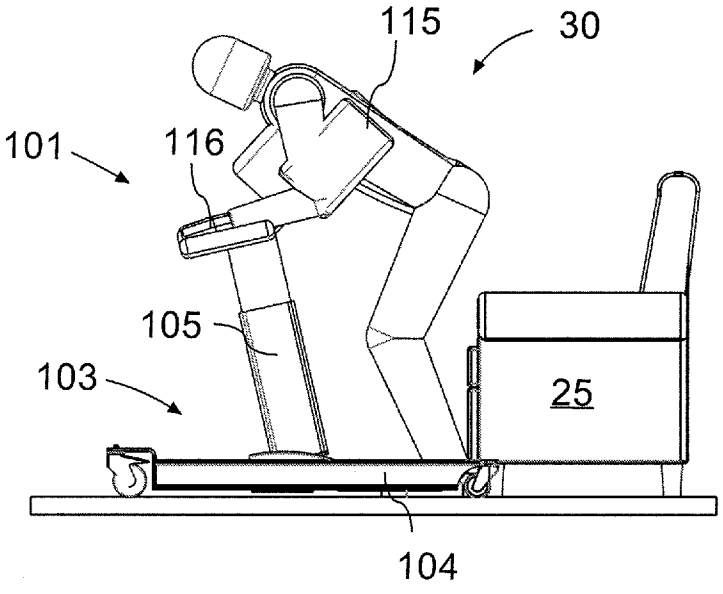
FIG. 41 shows another embodiment of the apparatus for assisting a person.

FIGS. 41 and 42 illustrate yet another example embodiment of the apparatus 101 that is largely identical to the embodiment of FIGS. 1-39. In this embodiment the vertical column 105 is pivotally supported from the base 103 that comprises parallel spaced bars 10. A rotational actuator, such as an actuator including an electric drive motor and a reduction gear controls the angular position of the vertical column 105. In this example embodiment the torso support 115 is rotationally connected to a top section 116 that is attached to the upper end of the vertical column 105. The top section 116 includes a rotational actuator for rotating the torso support 115 relative to the top section 116.

In operation, vertical adjustments, i.e. height adjustments of the position of the torso support are achieved in the same way as in the embodiments according to FIGS. 1-39, by activation of the linear actuator in the vertical column 105. Adjustments in the horizontal position of the torso support are achieved by rotation of the vertical column 105 about its pivot point at the base 103 as obtained by the rotational actuator.

Figure 43:
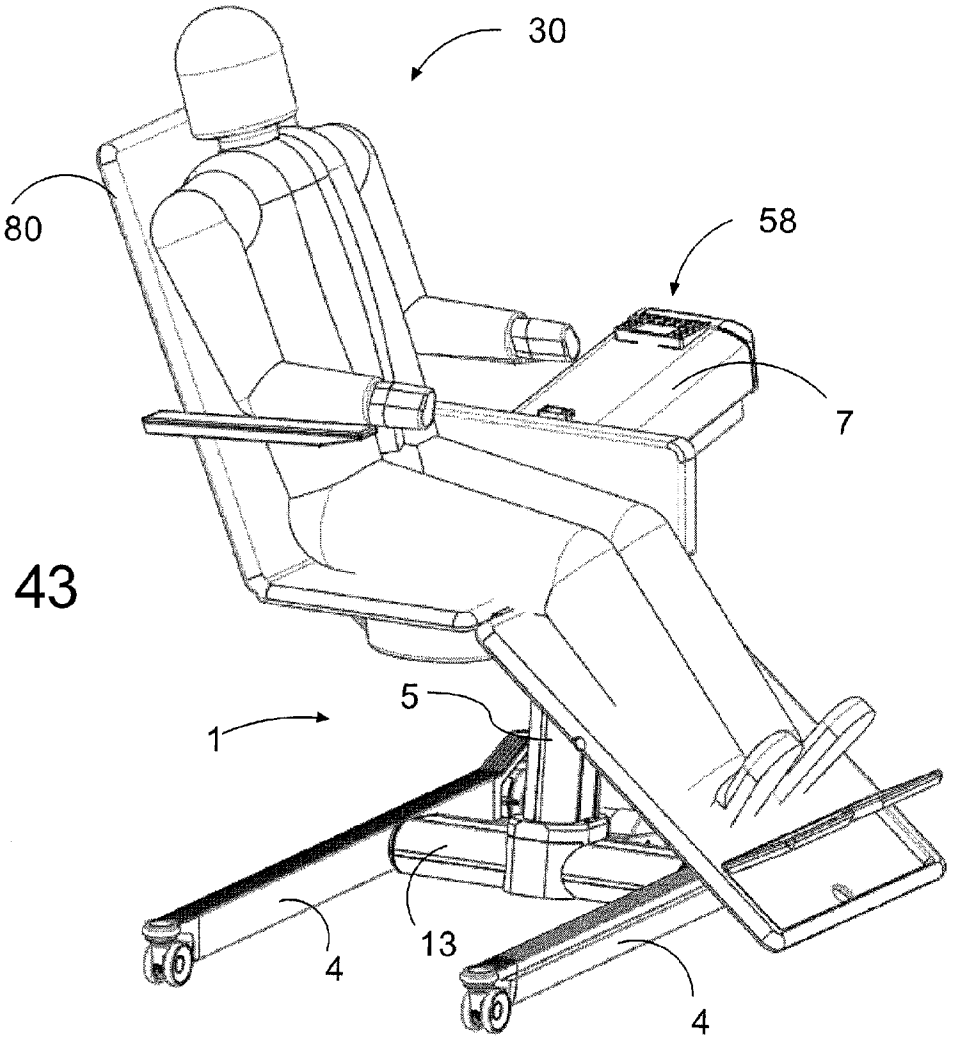
FIG. 43 shows another embodiment of the apparatus according to FIG. 1, wherein the torso support is swapped with a stretcher that can assume a seat like configuration with the stretcher in a seat like configuration.
Figure 44:
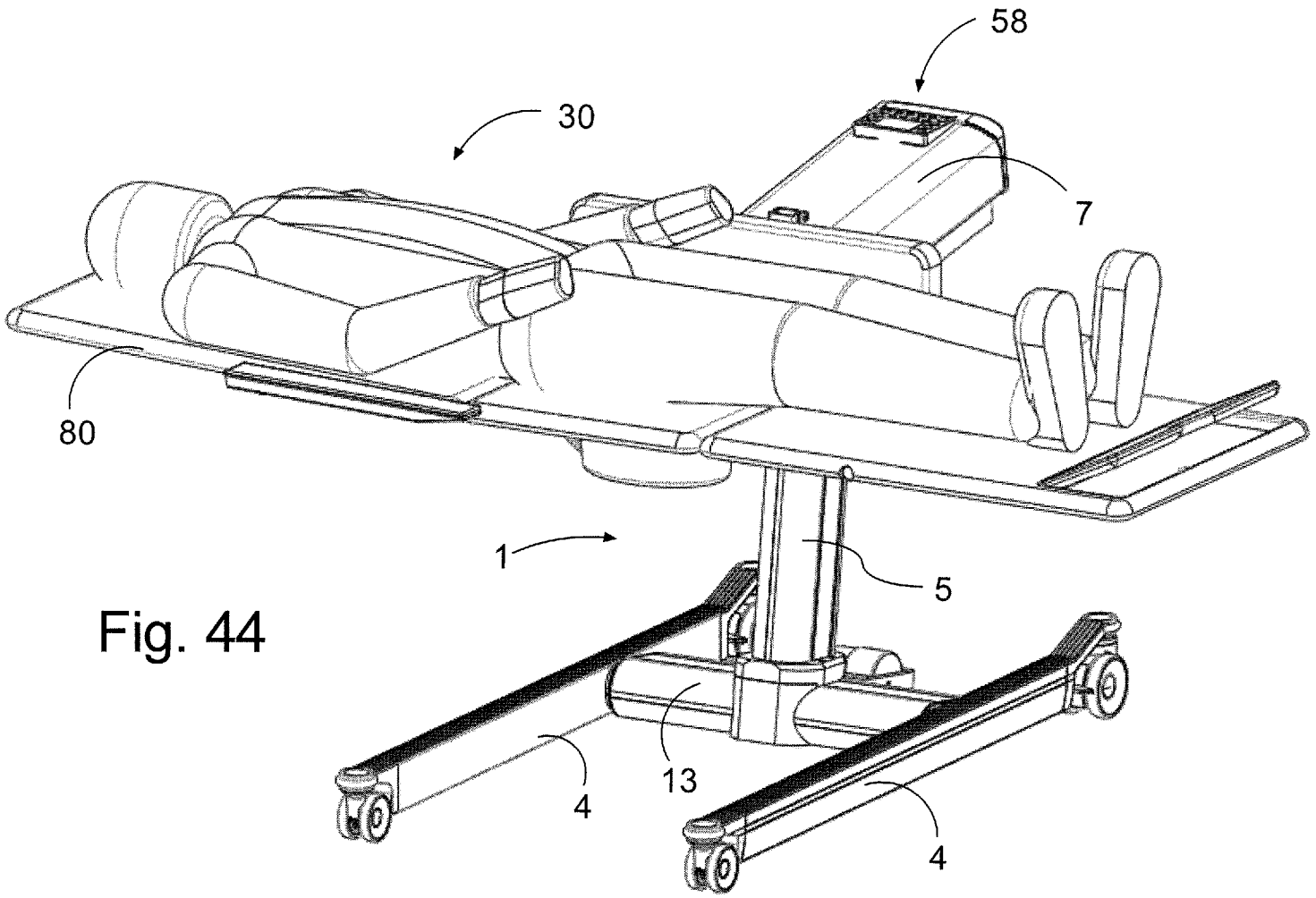
FIG. 44 shows the apparatus and the stretcher of FIG. 43 with the stretcher in a stretched position.
Figure 45:
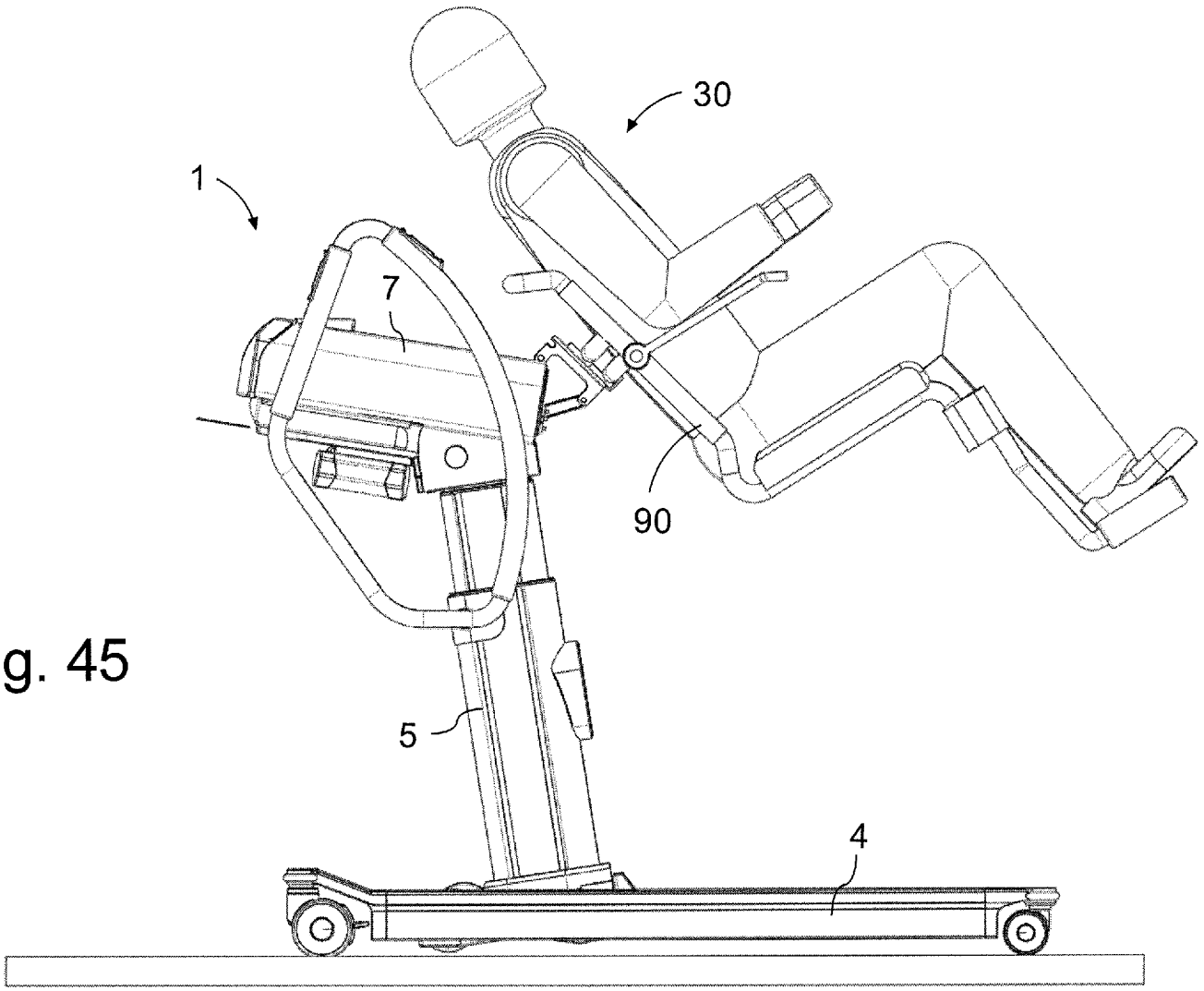
FIG. 45 is another embodiment of the apparatus according to claim 1, wherein the torso support is swapped with a toilet seat.

FIG. 43 shows another embodiment of the apparatus 1, wherein the torso support is swapped with a stretcher 80 that can assume a seat like configuration with the stretcher in a seat like configuration. The stretcher 80 is releasably attached to the free end of the horizontal column 7. The stretcher 80 can be moved by the apparatus 1 using the actuators in the vertical column 5 and the horizontal column 7 is in the embodiments described above. The rotational actuator can also tilt the stretcher 80 if needed. With the stretcher releasably attached to the apparatus, the apparatus 1 can be used to transport the patient that needs full support of the stretcher, i.e. a patient that cannot stand even with the assistance of the torso support. Since the apparatus is in an embodiment wheeled, the apparatus can be used to transport such patients/persons 30. FIG. 44 shows the apparatus 1 and the stretcher 80 a stretcher in a stretched position, and the person 30 to be transported laying on his/her back on the stretcher 80. FIG. 45 shows the apparatus 1, with a seat 90, preferably the toilet seat 90 with an opening in the central portion of the seat releasably attached to the free end of the horizontal column 7. The apparatus one can be used to lower end raise the toilet seat with or without the person/patient 30 on the toilet seat, using the actuator in the vertical column 5 and the rotational actuator can be used to tilt the toilet seat 90, with or without the person/patient 30 on the toilet seat 90. The actuator in the vertical column 7 can also be used to make adjustments of the position of the toilet seat 90 in the horizontal direction. Because the apparatus 1 in an embodiment can be wheeled, it is possible to transport a patient/person 32 and from a toilet with the aid of the apparatus 1. The torso support 8, the stretcher 80 and the toilet seat 90 are releasably attached to the free end of the horizontal column 7 at the rotational actuator, e.g. to the frame 36 with a quick coupling or snap fit coupling that it is easy for operating personnel to change the patient support attachment 8,80,90. Thus, the actuator arrangement is configured to have one of the patient support attachments releasably attached thereto. In an embodiment the apparatus one is provided with at least two different patient support attachments that can be releasably attached to the free end of the actuator arrangement of the apparatus 1. Although the apparatus has been shown as a movable lift, it can be adapted to be either floor-, wall- or toilet mounted by suitable fastening means well-known in the art and therefore not illustrated here.

Although the embodiments above are disclosed using a smart card and a smart card reader, it is understood that any other suitable identification means, such as near field communication, input via the user ID, fingerprint, etc. can equally be used.

Although the teaching of this application has been described in detail for purpose of illustration, it is understood that such detail is solely for that purpose, and variations can be made therein by those skilled in the art without departing from the scope of the teaching of this application.

The term "comprising" as used in the claims does not exclude other elements or steps. The term "a" or "an" as used in the claims does not exclude a plurality. The single processor or other unit may fulfill the functions of several means recited in the claims.

The invention claimed is:

1. An apparatus for assisting a person to move from a seated position on a seat or the like to a standing position and vice versa, said apparatus comprising:

a base;

an actuator arrangement supported by said base;

a torso support configured for supporting the torso and possibly also the underarms of the person to be supported with the chest of the person facing the torso support;

said torso support having a main engagement surface for engaging the chest of the person to be assisted;

said actuator arrangement being configured to be able to move said torso support up and down over a range of vertical positions and said actuator arrangement being configured to be able to move said torso support back and forth over a range of horizontal positions in a direction substantially perpendicular to said main engagement surface;

wherein said actuator arrangement is configured to move said torso support in said vertical range of positions independently of the horizontal position of the torso support;

wherein said actuator arrangement is configured to move said torso support in said horizontal range of positions independently of the vertical position of the torso support; and a rotational actuator operatively connected to said torso support for rotating said torso support about a substantially horizontal pivot axis, wherein said pivot axis is substantially parallel to said main engagement surface.

2. An apparatus according to claim 1, wherein the actuator arrangement including said rotational actuator is connected to a processor and operated under command of said processor.

3. An apparatus according to claim 1, wherein the rotational angle of said torso support can be adjusted independently of the horizontal position of the torso support and independently of the vertical position of the torso support.

4. An apparatus according to claim 1, wherein said rotational actuator comprises an electric drive motor.

5. An apparatus according to claim 1, wherein said actuator arrangement comprises two linear actuators with an electric drive motor each, said apparatus further comprising a processor operatively coupled to all of said electric drive motors and said processor being configured to control the activation of said drive motors simultaneously.

6. A method for operating a person lift for assisting a person in a raising or lowering movement, said apparatus comprising a base: an actuator arrangement supported by said base; a torso support configured for supporting the torso and possibly also the underarms of the person to be supported with the chest of the person facing the torso support; said torso support having a main engagement surface for engaging the chest of the person to be assisted; said actuator arrangement being configured to be able to move said torso support up and down over a range of vertical positions and said actuator arrangement being configured to be able to move said torso support back and forth over a range of horizontal positions in a direction substantially perpendicular to said main engagement surface; said actuator arrangement is configured to move said torso support in said vertical range of positions independently of the horizontal position of the torso support; and said actuator arrangement is configured to move said torso support in said horizontal range of positions independently of the vertical position of the torso support; a rotational actuator operatively connected to said torso support for rotating said torso support about a substantially horizontal pivot axis, being substantially parallel to said main engagement surface; said method comprising carrying out a movement with said torso support for supporting said person according along a predetermined path and with a predetermined rotational angle for each position along said path.

* * * * *